US007977859B2

(12) United States Patent
Suzuki et al.

(10) Patent No.: US 7,977,859 B2
(45) Date of Patent: Jul. 12, 2011

(54) IMAGE DISPLAY APPARATUS WITH PARTICULAR ELECTRON EMISSION REGION LOCATION

(75) Inventors: Mutsumi Suzuki, Kodaira (JP); Toshiaki Kusunoki, Tokorozawa (JP)

(73) Assignee: Hitachi, Ltd., Tokyo (JP)

( * ) Notice: Subject to any disclaimer, the term of this patent is extended or adjusted under 35 U.S.C. 154(b) by 363 days.

(21) Appl. No.: 12/155,389

(22) Filed: Jun. 3, 2008

(65) Prior Publication Data

US 2009/0102376 A1 Apr. 23, 2009

(30) Foreign Application Priority Data

Oct. 17, 2007 (JP) ..... 2007-270027

(51) Int. Cl.
*H01J 1/62* (2006.01)
*H01J 63/04* (2006.01)

(52) U.S. Cl. ..... 313/497; 313/495; 313/496; 313/310

(58) Field of Classification Search ..... 313/495–497, 313/310, 238
See application file for complete search history.

(56) References Cited

U.S. PATENT DOCUMENTS

| | | | | |
|---|---|---|---|---|
| 2005/0140268 | A1* | 6/2005 | Lee et al. | 313/495 |
| 2006/0186781 | A1* | 8/2006 | Kuroda et al. | 313/311 |
| 2006/0267471 | A1* | 11/2006 | Hwang et al. | 313/310 |
| 2006/0290259 | A1* | 12/2006 | Song et al. | 313/495 |
| 2007/0138939 | A1* | 6/2007 | Jin | 313/495 |
| 2009/0001870 | A1* | 1/2009 | Suzuki et al. | 313/502 |

FOREIGN PATENT DOCUMENTS

| | | |
|---|---|---|
| JP | 2004-363075 | 10/2003 |
| JP | 2007-048548 | 8/2005 |

OTHER PUBLICATIONS

Nobuyasu Negishi et al., "High Efficiency Electron-Emission in Pt.SIO*x*/Si/Al Structure", Jpn. J. Appl. Phys. vol. 36 (Jul. 1997) pp. L939-L941.

Nobuyoshi Koshida et al., "Cold Electron Emission from Electroluminescent Porous Silicon Diodes", Jpn. J. Appl. Phys. vol. 34 (Jun. 1995) pp. L705-L707.

Toshiaki Kusunoki et al., "Emission Current Enhancement of MIM Cathodes by Optimizing the Tunneling Insulator Thickness", IEEE Transactions of electron Devices, vol. 49, No. 6, Jun. 2002, pp. 1059-1065.

E. Yamaguchi et al., "A 10-in. Surface-Conduction Electron-Emitter Display", Journal of the SID 5/4, 1997, pp. 345-348.

Nobuyasu Negishi et al., "Characterization of an Advanced High-Efficiency Electron Emission Device", J. Vac. Sci., Technol, B23(2), Mar./Apr. 2005, pp. 682-686.

* cited by examiner

*Primary Examiner* — Joseph L Williams
*Assistant Examiner* — Kevin Quarterman
(74) *Attorney, Agent, or Firm* — Stites & Harbison PLLC; Juan Carlos A. Marquez, Esq.

(57) ABSTRACT

Degradation of an electron emission element by irradiation of the positive ion generated inside a panel is suppressed. A deflection electrode is periodically disposed, and the electron emission region of an electron emission element is disposed so as not to include a center line between adjacent deflection electrodes, so that an electron beam trajectory is deflected and bombardment or irradiation of the generated positive ion to the electron emission region is prevented.

18 Claims, 28 Drawing Sheets

IMAGE DISPLAY APPARATUS WITH PARTICULAR ELECTRON EMISSION REGION LOCATION

CROSS-REFERENCE TO RELATED APPLICATION

The present application claims priority from Japanese Patent Application No. JP 2007-270027 filed on Oct. 17, 2007, the content of which is hereby incorporated by reference into this application.

TECHNICAL FIELD OF THE INVENTION

The present invention relates to an image display apparatus for displaying an image by using an electron emission element and a phosphor disposed in a matrix-form.

BACKGROUND OF THE INVENTION

An image display device referred to also as a matrix electron emitter display takes an intersection of electrode groups orthogonal to each other as a pixel, and provides an electron emission element on each pixel, and by adjusting an applied voltage (amplitude of applied voltage) or a pulse width of an applied voltage pulse to each electron emission element, amount of emitted electrons is adjusted, and the emitted electrons are accelerated in vacuum, and after that, and bombarded onto or irradiated at the phosphor, thereby to allow the phosphor of the bombarded portion to emit light. As the electron emission elements, there are those such as using a field emission type cathode, a MIM (Metal-Insulator-Metal) cathode, a carbon-nanotube cathode, a diamond cathode, a surface conduction electron emitter element, a ballistic electron surface-emitting cathode, and the like. Thus, the matrix electron emitter display denotes a cathode luminescent flat-panel display that combines the electron emission element and the phosphor.

FIG. 1 is a schematic view showing a cross section of the matrix electron emitter display. As shown in FIG. 1, in the matrix electron emitter display, a cathode plate 601 disposed with the electron emission-element and a phosphor plate 602 formed with a phosphor are disposed facing with each other. In order that the electron emitted from an electron emission element 301 reaches the phosphor plate to excite the phosphor to emit light, a space surrounded by the cathode plate, the phosphor plate, and a frame component 603 is kept vacuum. To withstand the atmosphere pressure from the outside, a spacer (support) 60 is inserted between the cathode plate and the phosphor plate.

The phosphor plate 602 includes an acceleration electrode 122, and the acceleration electrode 122 is applied with high voltage of approximately 3 KV to 12 KV. The electrons emitted from the electron emission element 301 are accelerated by this high voltage, and after that, are bombarded onto or irradiated at the phosphor, thereby exciting the phosphor to emit light.

The electron emission element used for the matrix electron emitter display includes a thin film electron emitter. The thin film electron emitter has a structure laminating a top electrode, an electron acceleration layer, and a base electrode, and includes a MIM (Metal-Insulator-Metal) cathode, a MOS (Metal-Oxide-Semiconductor) type cathode, a ballistic electron surface-emitting cathode, a HEED (High-Efficiency Electron Emission Device) type cathode, and the like. The structure of the MIM cathode is, for example, described in Japanese Patent Application Laid-Open Publication No. 2004-363075 (Patent Document 1). The MOS type cathode uses a stacked film comprising of semiconductor and insulator for the electron acceleration layer, and for example, is described in Japanese Journal of Applied Physics, Vol. 36, Part 2, No. 7B, pp. L939-L941 (1997) (Non-Patent Document 1). The ballistic electron surface-emitting cathode uses porous silicon and the like for the electron acceleration layer, and for example, is described in Japanese Journal of Applied Physics, Vol. 34, Part 2, No. 6A, pp. L705-L707 (1995) (Non-Patent Document 2). The thin film electron emitter emits the electron accelerated in the electron acceleration layer into vacuum. Further, the MIM cathode uses a metal for the top electrode and the base electrode, and uses an insulator for the electron acceleration layer, and for example, is described in IEEE Transactions on Electron Devices, Vol. 49, No. 6, pp. 1059-1065 (2002) (Non-Patent Document 3). The HEED type cathode uses a stacked layer of silicon (Si) and $SiO_2$ for the electron acceleration layer, and for example, is described in Journal of Vacuum Science and Technologies, B, vol. 23, No. 2 (2005), pp. 682-686 (Non-Patent Document 5).

FIG. 2 is an energy band diagram showing an operation principle of the thin film electron emitter. A base electrode 13, an electron acceleration layer 12, and a top electrode 11 are stacked, and a state when a plus voltage is applied to the top electrode 11 is illustrated. In the case of the MIM cathode, as the electron acceleration layer 12, an insulator is used. By the voltage applied between the top electrode and the base electrode, an electric field is generated inside the electron acceleration layer 12. By this electric field, an electron from inside the base electrode 13 flows into the electron acceleration layer 12 by tunneling phenomenon. This electron is accelerated by the electric field in the electron acceleration layer 12, and becomes a hot electron. When this hot electron passes through the top electrode 11, a part of the electron loses energy by inelastic scattering and the like. The electron having kinetic energy larger than a work function $\Phi$ of the surface at a point of time when having reached an interface between the top electrode 11 and a vacuum (that is, the surface of the top electrode 11) is emitted from the surface of the top electrode 11 into vacuum 10. In the present specification, the current flowing between the base electrode 13 and the top electrode 11 by this hot electron is referred to as a diode current Jd, and the current emitted into vacuum is referred to as an emission current Je.

When compared with a field emission type cathode, the thin film electron emitter has characteristics suitable for the display apparatus such as strong resistance to surface contamination, small in divergence of the emitted electron beam so that a high-resolution display apparatus can be realized, small in operation voltage, the drive circuit driver at low voltage, and the like.

On the other hand, in the thin film electron emitter, only a part of the current from among the drive currents is emitted into vacuum (emission current Je). Here, the drive current is a current flowing between the top electrode and the base electrode, and is referred to also as the diode current Jd. A ratio $\alpha$ (electron emission ratio $\alpha$=Je/Jd) of the emission current Je to the diode current Jd is approximately 0.1% to several tens %. That is, to obtain the emission current Je, the drive current (diode current) of Jd=Je/$\alpha$ is required to be fed to the thin film electron emitter from the drive circuit. The electron emission ratio $\alpha$ is referred to also as an electron emission efficiency.

In this manner, in the matrix electron emitter display using the thin film electron emitter as the electron emission element, the current to drive the element is increased. Hence, it is necessary that a current feeding capacity to the electron emission-element's electrode (in this case, it denotes the base electrode or the top electrode) from an electrode wiring is sufficiently increased.

The electron emission element used for the matrix electron emitter display includes a surface conduction electron emitter element. The surface conduction electron emitter element, for example, is described in Journal of the SID, vol. 5 (1997) pp. 345-348 (Non-Patent Document 4). The surface conduction electron emitter element, as shown in FIG. 3, provides a gap of several nanometers to several tens nanometers between a cathode electrode film 813 and an anode electrode film 811. A voltage of several tens volts is applied between the anode electrode film 811 and the cathode electrode film 813. The electron 912 emitted from the cathode electrode film 813 flows into the anode electrode film 811, and becomes the drive current Jd. A part of the electron constituting the Jd does not flow into the anode electrode film 811, but becomes an emitted electron 911, and reaches the acceleration electrode 122. The current of the emitted electron becomes an emitted current Je (since the electron is a minus charge, the direction to which the electron flows and the direction of the emission current are reversed). The electron emission ratio Je/Jd is approximately several % to ten %. In this manner, in the matrix electron emitter display using the surface conduction electron emitter element as the electron emission element, the current to drive the element is increased. Hence, it is necessary that a current feeding capacity to the electron emission-element's electrode (in this case, it denotes the anode electrode film 811 and the cathode electrode film 813) from an electrode wiring is sufficiently high.

As described above, the acceleration electrode 122 provided on the phosphor plate 602 is applied with a high voltage of approximately 3 KV to 12 KV, and the electron emitted from the electron emission element 301 is accelerated by this high voltage, and after that, is bombarded onto the phosphor. The reason why the electron is excited by high voltage of 3 KV or more is because, the higher the acceleration voltage is, the deeper the penetration depth of the electron to the phosphor is, and the luminous efficiency and life of the phosphor are increased.

SUMMARY OF THE INVENTION

However, when the matrix electron emitter display is operated for a long time in a state in which a high voltage is applied to the acceleration electrode, a problem has arisen that a long-term degradation of the electron emission element over operation time is more serious. Here, the long-term degradation over operation time of the electron emission element means phenomenon such as long-term decrease in the amount of emission current over operation time or damages of the electron emission element. That is, such long-term degradation over operation time becomes a factor of inhibiting the image quality and long life of the image display apparatus.

An object of the present invention is to suppress the long-term degradation over operation time or change with the passage of time of the electron emission element in order to provide an image display apparatus providing with high quality images as well as a longer operation life.

From among various aspects of the invention disclosed in the present specification, an outline of the representative aspect will be described briefly as follows.

That is, the image display apparatus of the present invention includes a display panel having a cathode plate and a phosphor plate; and a drive circuit. The cathode plate includes a plurality of electron emission elements, a plurality of scan lines mutually in parallel, and a plurality of data lines mutually in parallel and orthogonal to the scan lines. The electron emission element is a thin film electron emitter, in which a top electrode, an electron acceleration layer, and a base electrode are provided, and a part of the top electrode constitutes an electron emission region, and by applying a voltage between the top electrode and the base electrode, electrons are emitted from the electron emission region. The cathode plate includes a plurality of deflection electrodes, and at the same time, has a center line at a position dividing a distance between the inner edges of the adjacent deflection electrodes in two equal parts, the electron emission region is disposed so as not to include the center line.

Further, the image display apparatus of the present invention includes a display panel having a cathode plate and a phosphor plate, and a drive circuit. The cathode plate includes a plurality of electron emission elements, a plurality of scan lines mutually in parallel, and a plurality of data lines mutually in parallel and orthogonal to the scan lines. The electron emission element is a thin film electron emitter, in which a top electrode, an electron acceleration layer, and a base electrode are provided, and a part of the top electrode constitutes an electron emission region, and by applying a voltage between the top electrode and the base electrode, electrons are emitted from the electron emission region. Between the electron emission region and the phosphor plate, a shield electrode is provided, and in a projected plane projecting a pattern of the electron emission region and a pattern of the shield electrode, the electron emission region is disposed so as to be included in the shield electrode.

Further, the image display apparatus of the present invention is an image display apparatus including a display panel having a cathode plate and a phosphor plate, and a drive circuit. The cathode plate includes a plurality of electron emission elements, a plurality of scan lines mutually in parallel, and a plurality of data lines mutually in parallel orthogonal to the scan lines. The electron emission element includes a first electrode and a second electrode, and the first electrode is electrically connected to the scan line, and the second electrode is electrically connected to the data line, and the electron emission element includes an electron emission region. When a voltage is applied between the first electrode and the second electrode, electrons are emitted from the electron emission region, and the phosphor plate includes a phosphor and an acceleration electrode, and by allowing the emitted electrons to excite the phosphor to emit light, an image is displayed. In a projected plane projecting a component on the phosphor plate and a component on the cathode plate, the electron emission region is disposed so as not to be superposed with a region formed with the phosphor.

Further, the image display apparatus of the present invention includes a display panel having a cathode plate and a phosphor plate, and a drive circuit. The cathode plate includes a plurality of electron emission elements, a plurality of scan lines mutually in parallel, and a plurality of data lines mutually in parallel and orthogonal to the scan lines. The electron emission element includes a first electrode and a second electrode, and the first electrode is electrically connected to the scan line, and the second electrode is electrically connected to the data line. The electron emission element includes an electron emission region. When a voltage is applied between the first electrode and the second electrode, electrons are emitted from the electron emission region. The phosphor plate includes a phosphor, a black matrix, and an acceleration electrode, and by allowing the emitted electrons to excite the phosphor to emit light, an image is displayed. In a projected plane projecting a component on the phosphor plate and a component on the cathode plate, the electron emission region is disposed so as to be included in the black matrix.

According to the present invention, even when the electron emission element is operated for a long time in a state in which a high voltage of approximately 3 to 12V is applied to the acceleration electrode, the degradation of the electron emission element is reduced, and a high image quality is maintained, and an operation life of the image display apparatus can be improved.

BACKGROUND OF THE INVENTION

DESCRIPTIONS OF THE PREFERRED EMBODIMENTS

Figure 1:
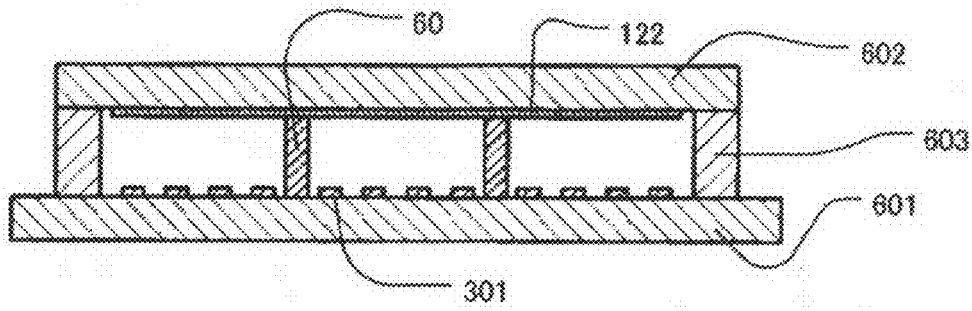
FIG. 1 Prior Art
FIG. 1 is a schematic view of a cross section of a matrix electron emitter display.
Figure 2:
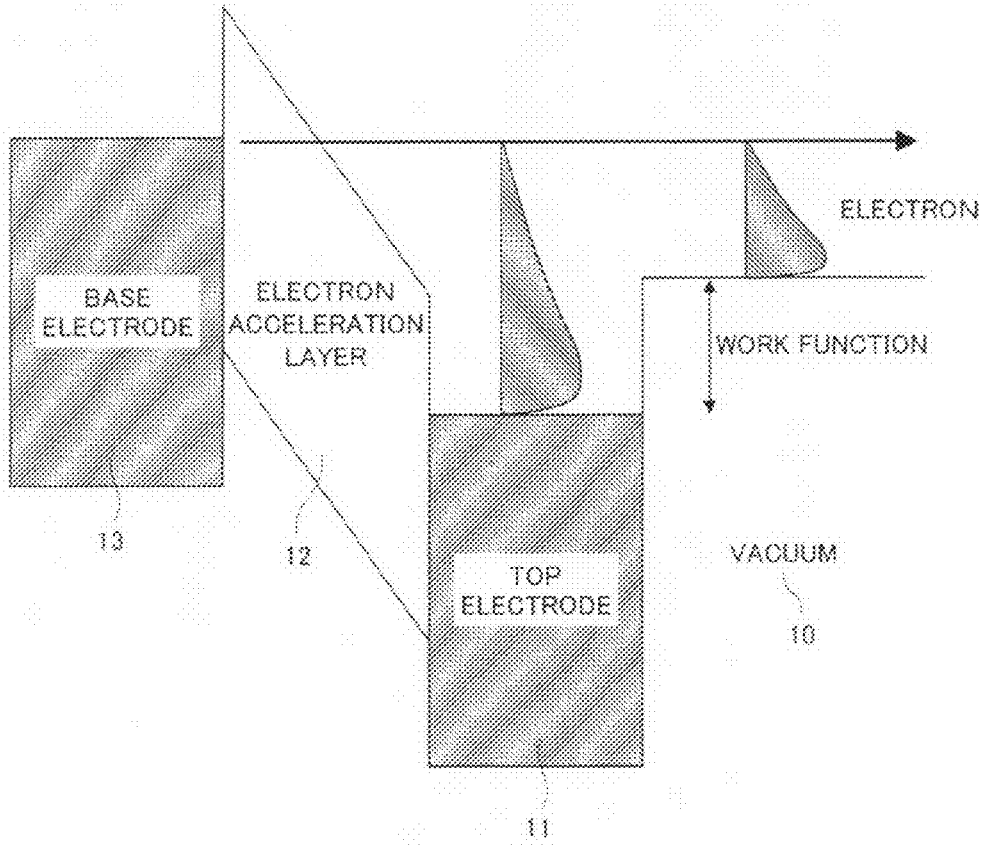
FIG. 2 Prior Art
FIG. 2 is a view for explaining an electron emission mechanism of a thin film electron emitter.

Hereinafter, preferred embodiments of an image display apparatus according to the present invention will be described in detail with reference to several embodiments shown in the drawings.

First Embodiment

A first embodiment of the present invention is an example in a case when the present invention is applied to a MIM cathode, a surface conduction electron emitter element and the like. Here, first, a cause of degradation phenomenon of the electron emission element generated when operated in a state in which a high voltage is applied to a phosphor screen will be described.

As described in FIG. 1, the electron emitted from an electron emission element 301 is accelerated by a phosphor-screen voltage Va, and after that, is bombarded onto or irradiated at an acceleration electrode 122 and a phosphor. Here, the phosphor-screen voltage means a voltage applied to the acceleration electrode 122, and it is typically Va=3 to 12 KV. When the electron accelerated to 1 KV or more bombards the phosphor and gas molecules, it is often that the electron ionizes atoms or molecules, thereby to generate positive ion. The positive ion is accelerated by the electric field between a phosphor plate 602 and a cathode plate 601. The positive ion advances toward the cathode plate, and bombards the cathode plate. When this positive ion bombards the electron emission region of the electron emission element, the electron emission element is degraded.

Figure 4:
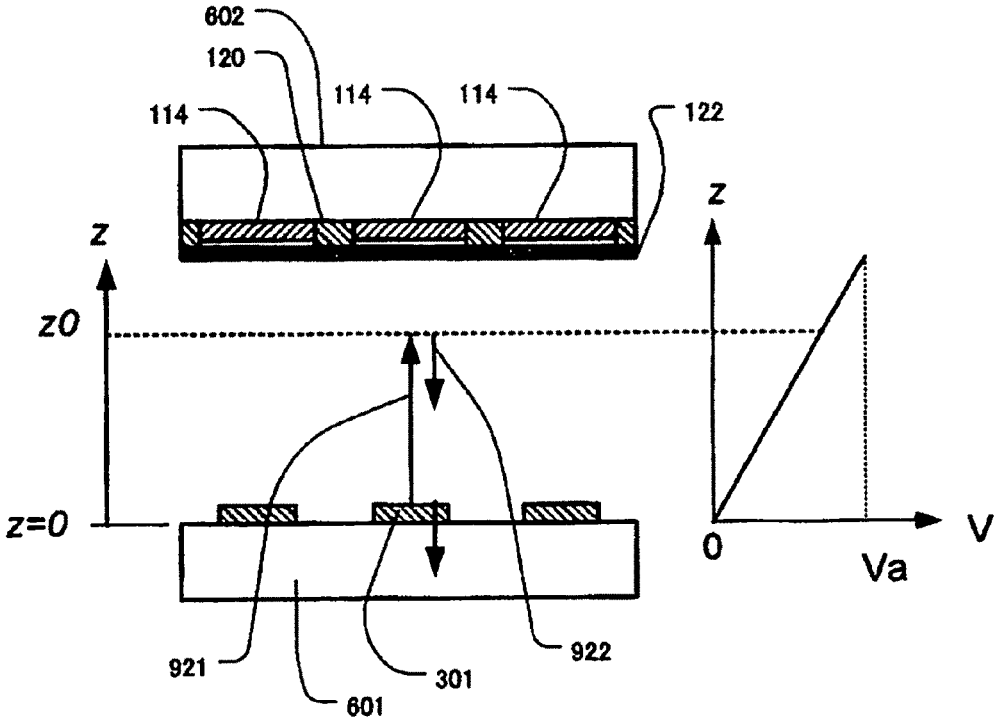
FIG. 4 is a schematic view showing potential distribution inside a display panel.

A specific description will be made by using FIG. 4. FIG. 4 is a view schematically showing a potential distribution between the phosphor plate 602 and the cathode plate 601, a trajectory 921 of electron, and a trajectory 922 of the positive ion. Between the phosphor plate 602 and the cathode plate 601, an approximately uniform electric field is formed, and therefore, its potential distribution is as shown in the right side graph of FIG. 4. Now, it is assumed that a positive ion is generated in the distance Z=z0 from the cathode plate. Assuming that the potential of z=z0 is V(z0), when this positive ion bombards or irradiates the electron emission element 301 by tracing the trajectory 922, kinetic energy carried by the positive ion is V(z0). Consequently, from among the space between the phosphor plate 602 and the cathode plate 601, the ion generated at a place close to the phosphor plate 602 enters the electron emission element 301 with higher energy.

Figure 5:
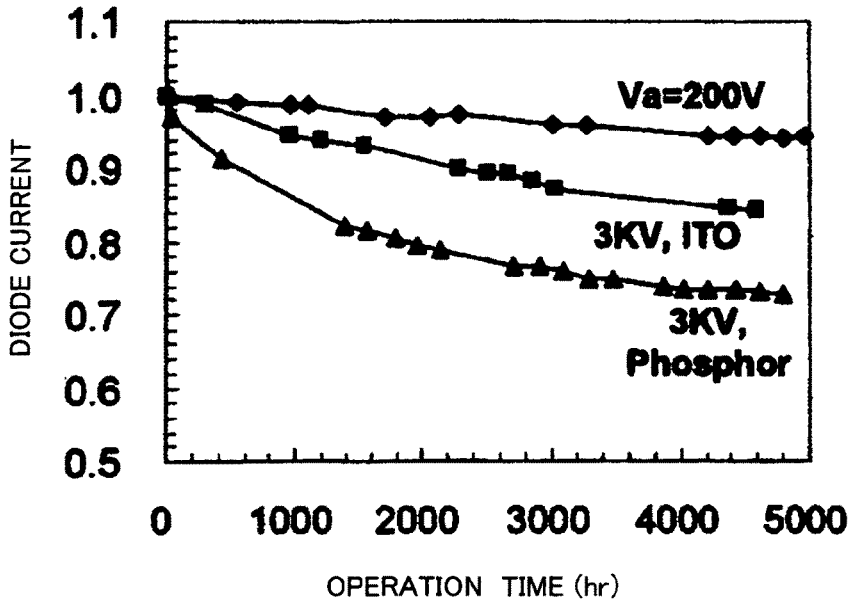
FIG. 5 is a view showing degradation of an electron emission element.

FIG. 5 shows a long-term change over operation time of diode current when the image display apparatus using the MIM cathode for the electron emission element 301 is operated for a long time. The axis of ordinate plots a value having normalized the diode current by an initial value (that is, a value divided by the initial diode current). When the phosphor screen voltage Va is 200V, the diode current is almost constant even when the apparatus is operated for a long time. However, when apparatus is operated with the phosphor screen voltage Va set to 3 KV, an amount of long-term change over operation time or change with the passage of time of the diode current is increased.

To check a cause of this degradation, a display panel deposited with ITO (Indium Tin Oxide) only as a phosphor screen, that is, a display panel not including a phosphor on the phosphor screen was prepared, and its long-term change of the diode current over operation time was checked (characteristics described as "3 KV, ITO" in FIG. 5). As a result, when a panel not including the phosphor (described as "3 KV, ITO" in FIG. 5) and an ordinary panel including the phosphor (described as [3 KV, phosphor] in FIG. 5) are compared, the panel including the phosphor is further larger in the amount of long-term change of the diode current over operation time. From this result, the following became clear.

There are mainly two kinds of causes which generate the positive ion. A first cause is a phosphor 114, and a second cause is a small amount of residual gas molecules inside the display panel. Since the phosphor 114 is bombarded or irradiated by the electron having an energy Va, heat is generated, so that the molecules are desorbed or the molecules can be desorbed or the phosphor surface can be decomposed owing to the electron bombardment. When the electron is bombarded onto or irradiated at the molecules and atoms generated at this time, ions are generated. Further, the potential of the phosphor screen, as shown in FIG. 4, is the maximum between the phosphor plate 602 and the cathode plate 601, and therefore, the positive ion generated in the phosphor is great in incident energy at the time of irradiation to the electron emission element 301, and the damages given to the electron emission element is great.

Hence, in the first embodiment of the present invention, to prevent the positive ion generated by the phosphor 114 from bombarding or irradiating the electron emission element, the phosphor 114 and the electron emission region are appropriately disposed as described below.

Figure 6:
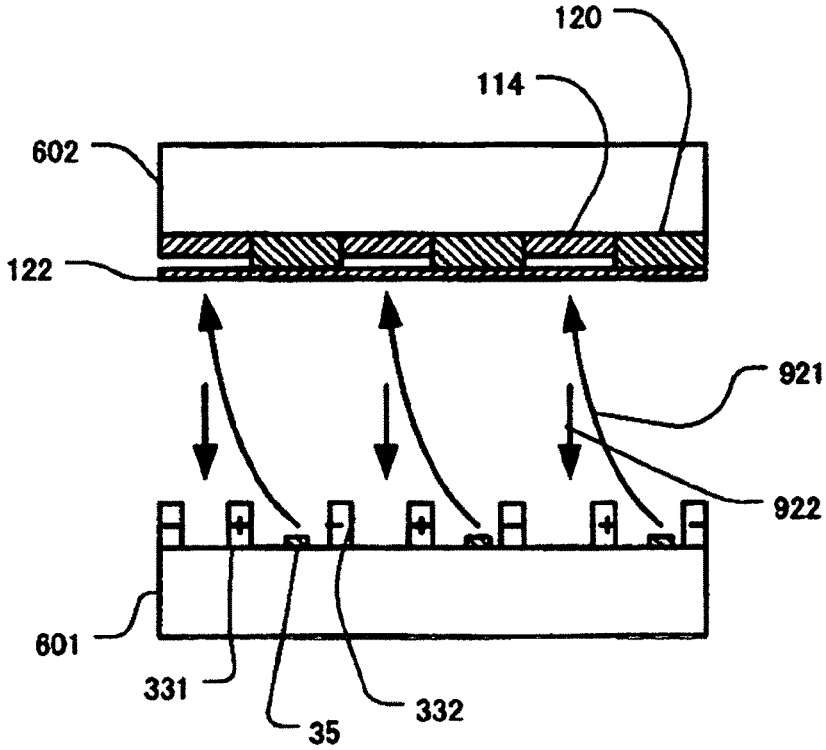
FIG. 6 is a cross section schematic view of the display panel of a first embodiment of an image display apparatus according to the present invention.

FIG. 6 is a view schematically showing a cross section of the display panel according to the first embodiment of the present invention. While the display panel is typically composed of sub pixels of 1000 rows X several thousand columns, FIG. 6 shows only three sub pixels from among those sub pixels. Here, the sub pixel corresponds to each sub pixel of a red color sub pixel, a blue color sub pixel, and a green color sub pixel constituting one color pixel in a color image display apparatus. In a monochrome image display apparatus, the sub pixel corresponds to one pixel. The cathode plate 601 is formed with an electron emission element having an electron emission region 35. In FIG. 6, only the electron emission region 35 is shown from among the electron emission elements.

Figure 3:
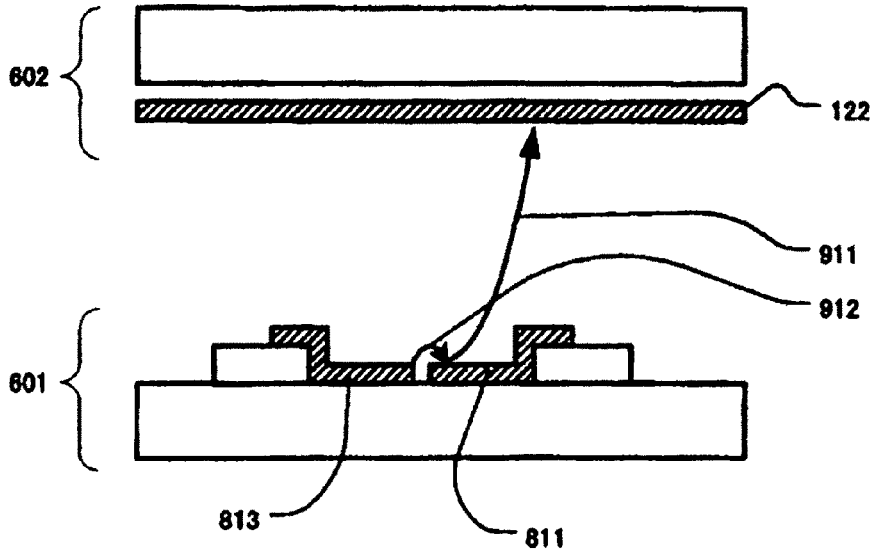
FIG. 3 Prior Art
FIG. 3 is a view showing a structure of a surface conduction electron emitter element.

In the present specification, the electron emission region 35 denotes a part from which the electron is emitted from among the constituent components of the electron emission elements. In the thin film electron emitter, the electron emission region 35 corresponds to a top electrode on an electron acceleration layer. In a field emission electron emitter, the electron emission region 35 corresponds to an electron emitter tip. In the case of the surface conduction electron emitter element shown in FIG. 3, the electron emission region 35 corresponds to a cathode electrode film 813 and an anode electrode film 811.

In the case of a structure in which a plurality of electron emission sites are provided inside one sub pixel, the entire region provided with the electron emission sites inside one sub pixel is defined as the electron emission region 35. For example, in the case of the HEED cathode described in the Non-Patent Document 5, a plurality of electron emission sites having a diameter of approximately 1 μm are included in the top electrode inside one sub pixel, but in this case, the entire electron emission site inside one sub pixel is defined as the electron emission region 35.

The cathode plate 601 is formed with a beam deflection electrode A 331 and a beam deflection electrode B 332. By applying a voltage difference between the beam deflection electrode A and the beam deflection electrode B so as to generate a lateral electric field in a space close to the electron emission region 35, the trajectory 921 of the electron emitted from the electron emission region 35 is bent (deflected).

The phosphor screen 602 is formed with a phosphor region 114 and a black matrix 120. The phosphor region 114 is patterned with three kinds of a red color phosphor, a green color phosphor and a blue color phosphor in the color image display apparatus. Further, the acceleration layer 122 is formed. The fabrication method of the phosphor plate will be described in detail later according to a second embodiment. Corresponding to the deflected trajectory 921 of the electron beam, the position of the phosphor region 114 is disposed to be shifted from the position of the electron emission region 35.

Figure 7:
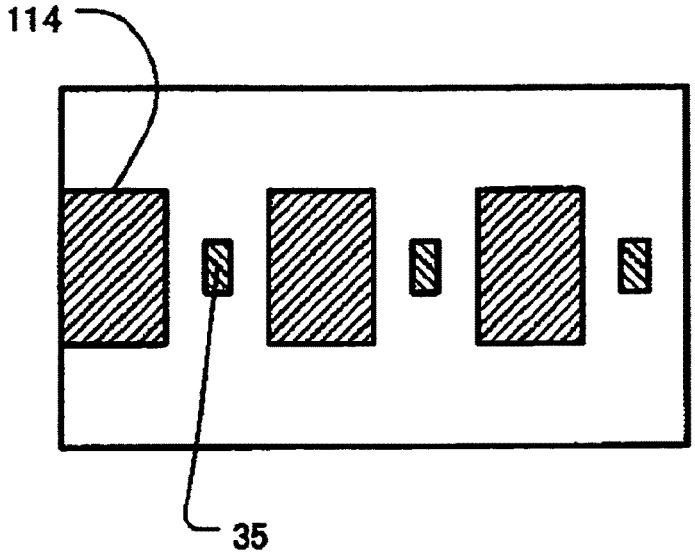
FIG. 7 is a view showing a projected plan view of a phosphor region and an electron emission region according to the first embodiment.

The characteristic of the present invention is a positional relation between the phosphor region 114 and the electron emission region 35. FIG. 7 is a top plan view (projected plan view) showing the phosphor region 114 and the electron emission region 35 by projecting them in the same plane (a projected plane). As apparent from FIG. 7, in the projected plan view, the phosphor region 114 and the electron emission region 35 of the electron emission element are disposed not to be superposed with each other. In the phosphor screen, since the regions other than the phosphor region 114 are formed with the black matrix 120, from another point of view, the electron emission region 35 is included in the black matrix 120 in the projected plan view.

As shown in FIG. 6, the positive ion generated in the phosphor region 114 is accelerated along the trajectory 922 of the positive ion, and bombards the cathode plate 601. Since a mass of the positive ion is more than 1000 times larger than that of the electron, the positive ion approximately goes straight almost not bending the trajectory in a lateral electric field, and therefore, the positive ion bombards the cathode plate directly below the phosphor region 114. Consequently, when the phosphor region 114 and the electron emission region 35 are disposed as shown in FIGS. 6 and 7, the positive ion is not irradiated at the electron emission region 35, and no degradation of the electron emission element occurs.

In FIGS. 6 and 7, as a means for deflecting the electron beam trajectory 921, though the lateral electric field by the potential difference between an electron beam deflection electrode A 331 and a beam deflection electrode B 332 is used, this is just an example, and even when another method of deflecting the trajectory is used, the same effect can be obtained. For example, as described in the embodiment to be described later, by constituting an electron lens by forming an appropriate electrode shape on the cathode plate 601, the beam may be deflected. Further, the electron emission element 301 used in the present embodiment may use any of the thin film electron emission element including the MIM cathode, the surface conduction electron emitter element, and the electric field emission type electron emission element including a carbon nanotube cathode.

Figure 8:
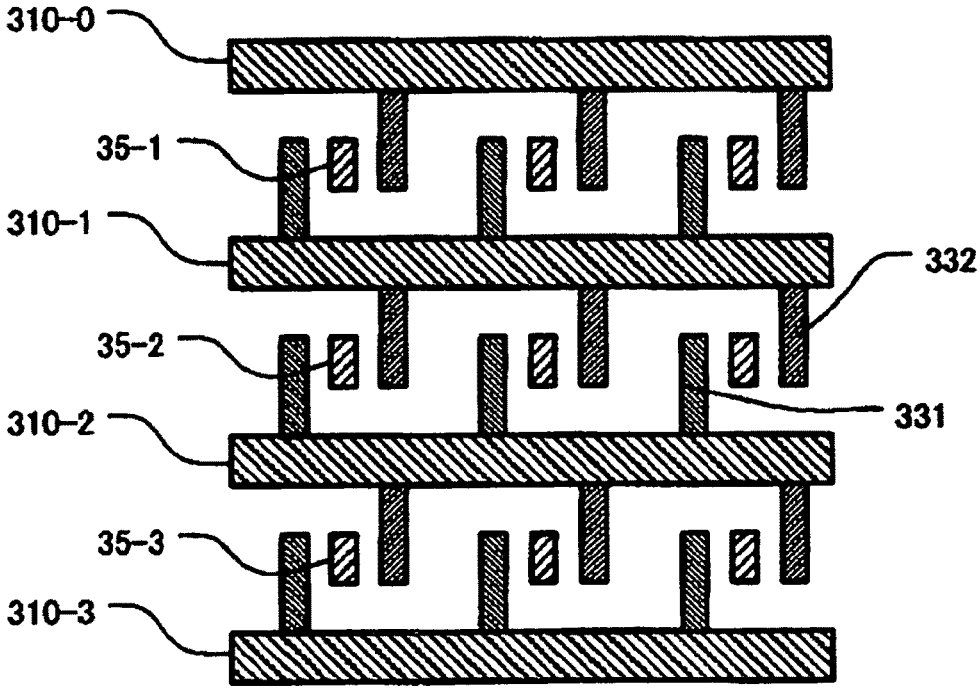
FIG. 8 is a view showing a cathode top plan view of the first embodiment.

FIG. 8 is a top plan view showing an electrode structure of the cathode plate 601 used in the first embodiment of the present invention. In FIG. 8, a part corresponding to the sub pixels of 3 rows×3 columns in the display panel was shown. Further, in FIG. 8, from among the components constituting the cathode plate, the electron emission region 35, the beam deflection electrode A 331 and the beam deflection electrode B 332, and a scan electrode 310 only are described.

Each scan electrode 310 has one side (upper side in FIG. 8) connected with the beam deflection electrode A 331, and has the opposite side connected with the beam deflection electrode B 332. Further, in FIG. 8, one electrode of an electron emission element 301-n (not shown) corresponding to an electron emission region 35-n is electrically connected to a scan line electrode 310-n. Here, n=1 to 3. Here, the "one electrode" of the electron emission element 301 is specifically as follows. In the case of the thin film electron emitter, it denotes a top electrode 11. In the case of the surface conduction electron emitter of FIG. 3, it is the anode electrode film 811. In the case of the field emission type electron emitter, it is a gate electrode.

Although not shown in FIG. 8, a data electrode 311 is disposed in a direction orthogonal to the scan electrode 310. The data electrode 311 is electrically connected to the other electrode of the electron emission element 301. Here, "the other electrode" of the electron emission element 301 is specifically as follows. In the case of the thin film electron emitter, it is the base electrode 13. In the case of the surface conduction electron emitter of FIG. 3, it is a cathode electrode film 813. In the case of the field emission type electron emitter, it is an emitter electrode. The scan electrode 310-(n−1) and the electron emission element 301-n corresponding to the electron emission region 35-n are not electrically connected.

Figure 9:
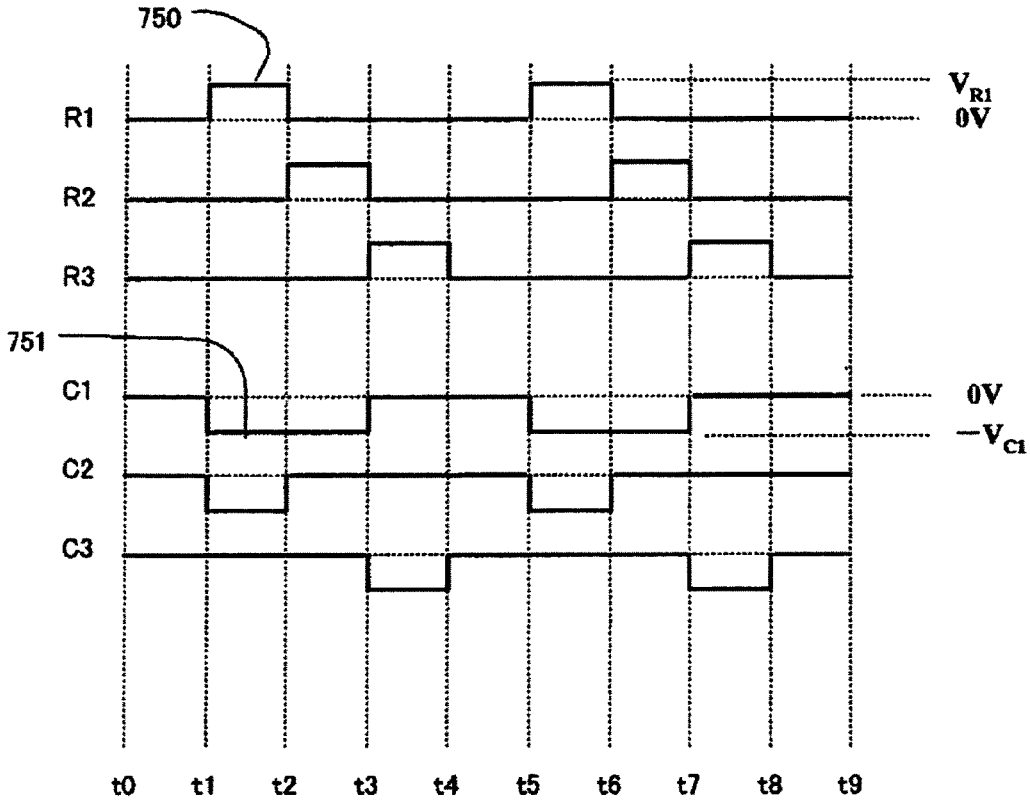
FIG. 9 is a view showing a drive waveform of the first embodiment.

FIG. 9 is a view showing waveforms of applied voltage to the scan electrode 310-n. Each scan electrode is sequentially applied with a scan pulse 750. The scan pulse 750 has a positive voltage amplitude $V_{R1}$. During a period when the scan pulse 750 is applied, the electron emission element 301 applied with a data pulse 751 in a data electrode emits the electron from the electron emission region 35.

As an example, a period of the time t2 to the time t3 is considered. In this period, since the scan pulse 750 is applied to the scan electrode 310-2, the electron is emitted from an electron emission region 35-2. At this time, the beam deflection electrode A 331 connected to the scan electrode 310-2 is applied with the positive voltage $V_{R1}$, and the voltage of the beam deflection electrode B 332 connected to a scan electrode 310-1 is zero. Consequently, as described in FIG. 6, close to the electron emission region 35-2, a lateral electric field is formed. By this electric field, as shown in FIG. 6, the electron beam trajectory 921 is deflected.

In the present embodiment, a case of using a positive polarity pulse as the scan pulse 750 has been shown as an example. It is obvious that the similar arrangement can be realized even when a negative polarity pulse is used as the scan pulse. In this case, the scan electrode may be connected with a terminal of the negative polarity side of the electron emission element, and the data electrode may be connected with a terminal of the positive polarity side of the electron emission element.

Second Embodiment

A second embodiment of the present invention uses a thin film electron emitter as an electron emission element. As compared with another cathode such as a field emission type cathode, the thin film electron emitter is small in spatial divergence of emitted electron beam. The reason is as follows. In the thin film electron emitter, the electron accelerated in an electron acceleration layer is emitted into vacuum from a top electrode. In the thin film electron emitter, since the top electrode and a base electrode are mutually disposed in opposition in parallel, the electric field inside the electron acceleration layer is a uniform electric field. Since the electron is accelerated by this uniform electric field, the spatial divergence of the emitted electron becomes small. That the spatial divergence of the emitted electron beam is small is favorable characteristics because a high-resolution image display apparatus can be realized.

On the other hand, as evident from FIG. 4, when the spatial divergence of the beam is small, a greater part of the positive ion generated somewhere along an electron trajectory 921 is bombarded onto or irradiated at an electron emission region 35. Hence, the thin film electron emitter which is excellent in beam directionality is greatly affected by the degradation of the electron emitter by a positive ion, and its countermeasure is required. In the present embodiment, an image display apparatus enhanced in durability against ion bombardment at the thin film electron emitter is provided.

Figure 10:
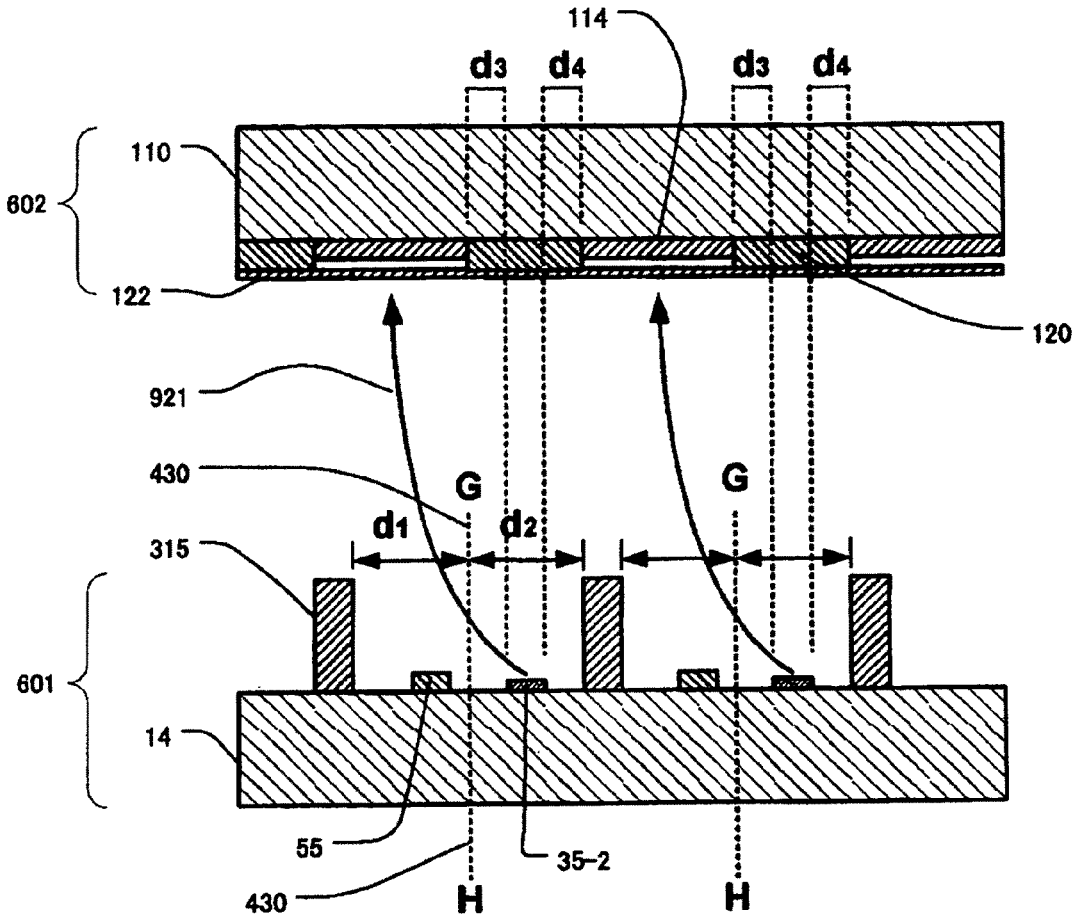
FIG. 10 is a view showing the cross section of the display panel of the image display apparatus according to the present invention.
Figure 11:
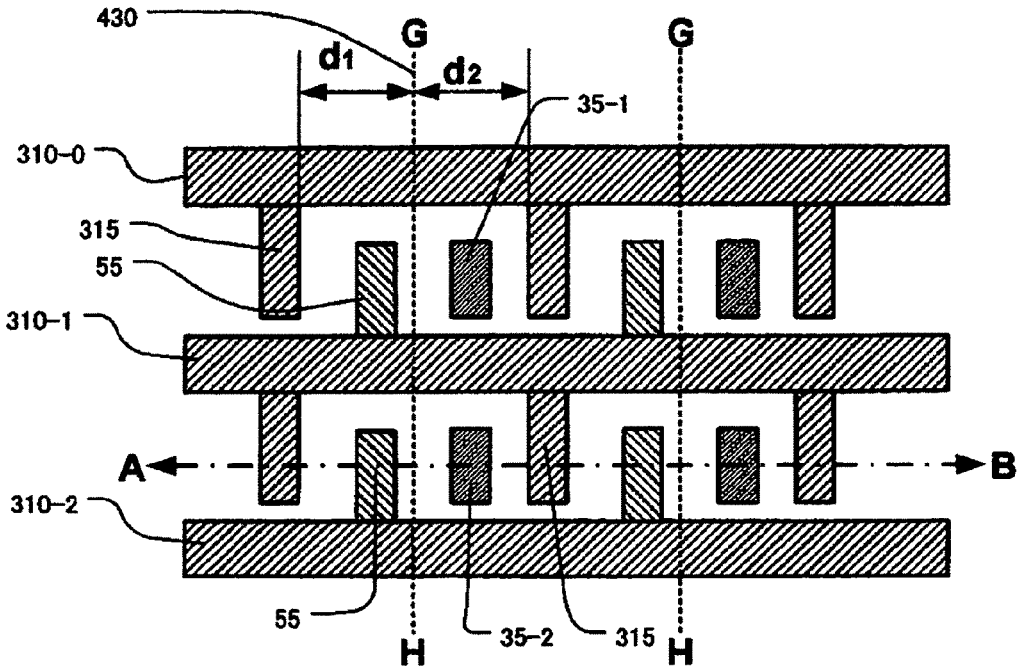
FIG. 11 is a top plan view of a cathode plate of a second embodiment of the image display apparatus according to the present invention.

FIG. 10 schematically shows a cross section of a display panel according to the second embodiment of the present invention. In FIG. 10, to make the characteristics of the second embodiment clear, main constituent components only are taken out and described. With respect to the thin film electron emitter, the electron emission region 35 only is described. The detail structure will be described later together with the manufacturing method thereof. Further, a top plan view corresponding to FIG. 10 is shown in FIG. 11. The cross section taken along line A-B of FIG. 11 corresponds to FIG. 10.

A scan line 310 is electrically connected to the electrode of an electron emission element 301 through a contact electrode 55. The electron emission element 301 has the electron emission region 35. In FIG. 11, a scan line 310-2 is connected to the electron emission element having an electron emission region 35-2. Further, a cathode plate 601 is provided with a deflection electrode 315. The deflection electrode 315 is at a position higher than the electron emission region 35, that is, formed thick in film thickness, and a local projection or locally projected high region is formed on the cathode plate 601.

The dotted lines G-H 430 shown in FIGS. 10 and 11 show a position of the center point of the distance (that is, the inside distance) between inner edges of the adjacent defection electrodes 315. That is, d1=d2 in FIG. 11. In the present specification, the G-H line 430 thus defined is referred to as a center line 430. The characteristics of the present embodiment are that the electron emission region 35 is disposed at such a position where the electron emission region 35 does not include the center line G-H 430 between the deflection electrodes forming the local projection. By taking such a disposition, the emitted electron beam can be deflected as described later.

Figure 12:
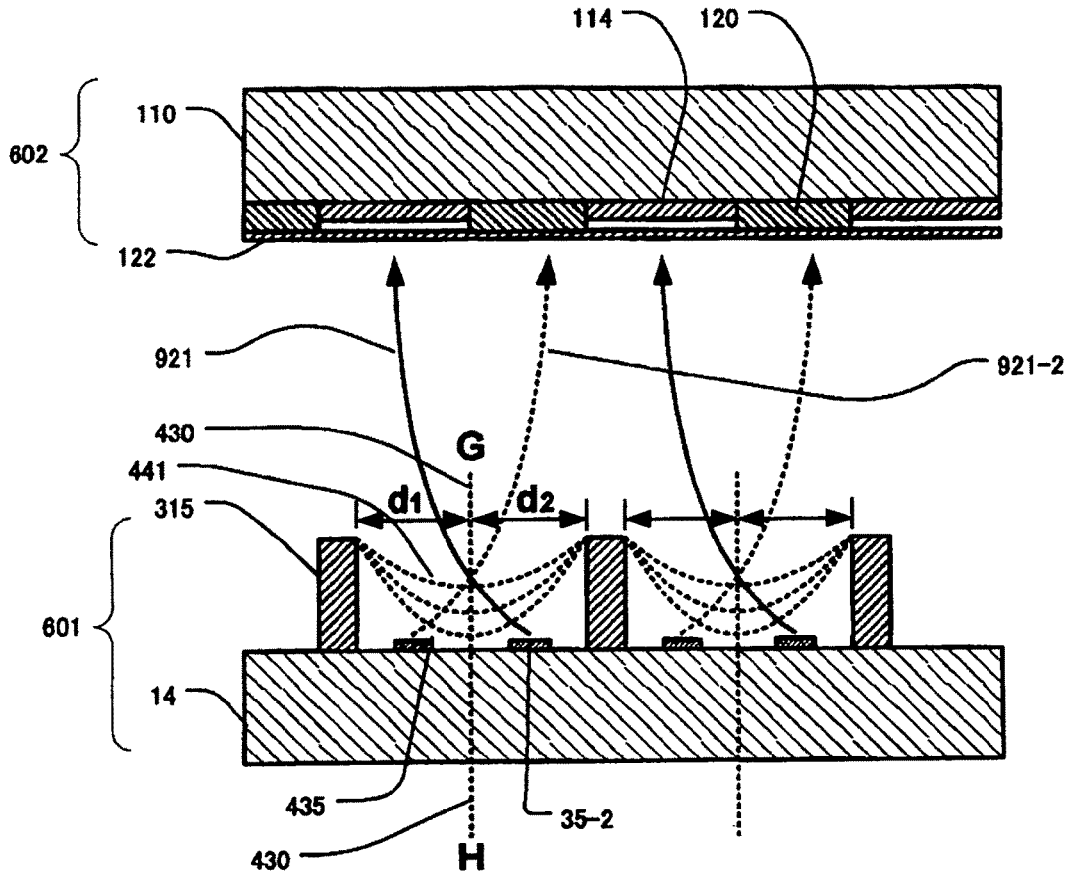
FIG. 12 is a view showing a mechanism by which an electron beam is deflected.

A beam deflection mechanism in the present embodiment will be described with reference to FIG. 12. In FIG. 12, there is shown schematically by dotted lines an equipotential surface 441 formed by periodic structure of the deflection electrode. An electron lens formed by this equipotential surface 441 deflects the electron beam emitted from the electron emission region 35 towards the center line 430. For purpose of illustration, in FIG. 12, a virtual electron emission region 435 was virtually disposed, and a trajectory 921-2 of the electron beam emitted from the virtual electron emission region 435 was also shown. The beam trajectory 921-2 is also deflected towards the center line 430.

From this, it is evident that, if the electron emission region 35 is disposed not to straddle the center line 430, the emitted electron is deflected like the trajectory 921. This is a deflection principle of the electron beam in the present invention.

As described in FIG. 12, the electrode shape is preferably designed such that the emitted beam trajectory 921 from the electron emission region and the emitted beam trajectory 921-2 from the virtual electron emission region 435 have a cross-over (intersection). By so doing, in the actual structure taking off the virtual electron emission region 435, the beam deflection amount becomes large, and the positive ion is further prevented from entering the electron emission region.

The main factors that decide the characteristics of the electron lens for playing a role of deflecting the electron beam trajectory are four of (a) a difference in height between the deflection electrode and the top electrode, (b) a voltage difference between the deflection electrode and the top electrode, (c) a period of the deflection electrode (distance between the adjacent deflection electrodes), and (d) a phosphor screen voltage Va. The factor (a) (a difference in height between the deflection electrode and the top electrode) is, as evident from FIG. 12, an important factor to decide the electron lens characteristics. The larger the difference in height is, the larger the amount of beam deflection is.

Here, the "height" of the electrode is a height measured from the surface of a substrate 14 constituting the cathode plate 601, and is defined as a length from the surface of the substrate 14 to the highest region (highest part) of the electrode. That is, similarly to FIG. 30A to be described later, when the deflection electrode 315 is directly formed in the substrate 14, its film thickness becomes a height h0. Further, similarly to FIG. 30B, when the deflection electrode 315 is formed on a dielectric layer 385, a length up to the highest position of the deflection electrode 315 (h0 in the figure) defines the height. The "height" of the top electrode is also similarly defined. Even in the case of FIG. 30B, the height h0 mainly controls the electron lens characteristics.

As evident from the description in FIG. 12, in the present embodiment, at both sides of the electron emission region, the deflection electrode is present at a position higher than the electron emission region, so that the lateral electric field is formed, and the trajectory of the electron beam emitted from the electron emission region is deflected. To obtain a sufficient beam deflection amount, the deflection electrode is preferably made higher than the height of the top electrode by 2 μm or more.

As evident from the description in FIG. 12, the period of the deflection electrode (distance between the adjacent deflection electrodes) also affects the electron lens characteristics. When this period is made consistent with the period of the sub pixel, the beam deflection amount of each sub pixel becomes constant, which is preferable.

Further, as evident from the description in FIG. 12, the electrode (referred to as "protruded electrode") at a position higher than the height of the top electrode may be periodically disposed close to the top electrode. Consequently, even when the electrode is an electrode having a role different from the deflection electrode, if this electrode (protruded electrode) has a sufficient height difference with the top electrode, and moreover, is periodically disposed, such electrode can be taken as the deflection electrode. In the present embodiment, in such a case, the protruded electrode is regarded as performing the function of the deflection electrode, and such protruded electrode is taken as the deflection electrode.

Figure 13:
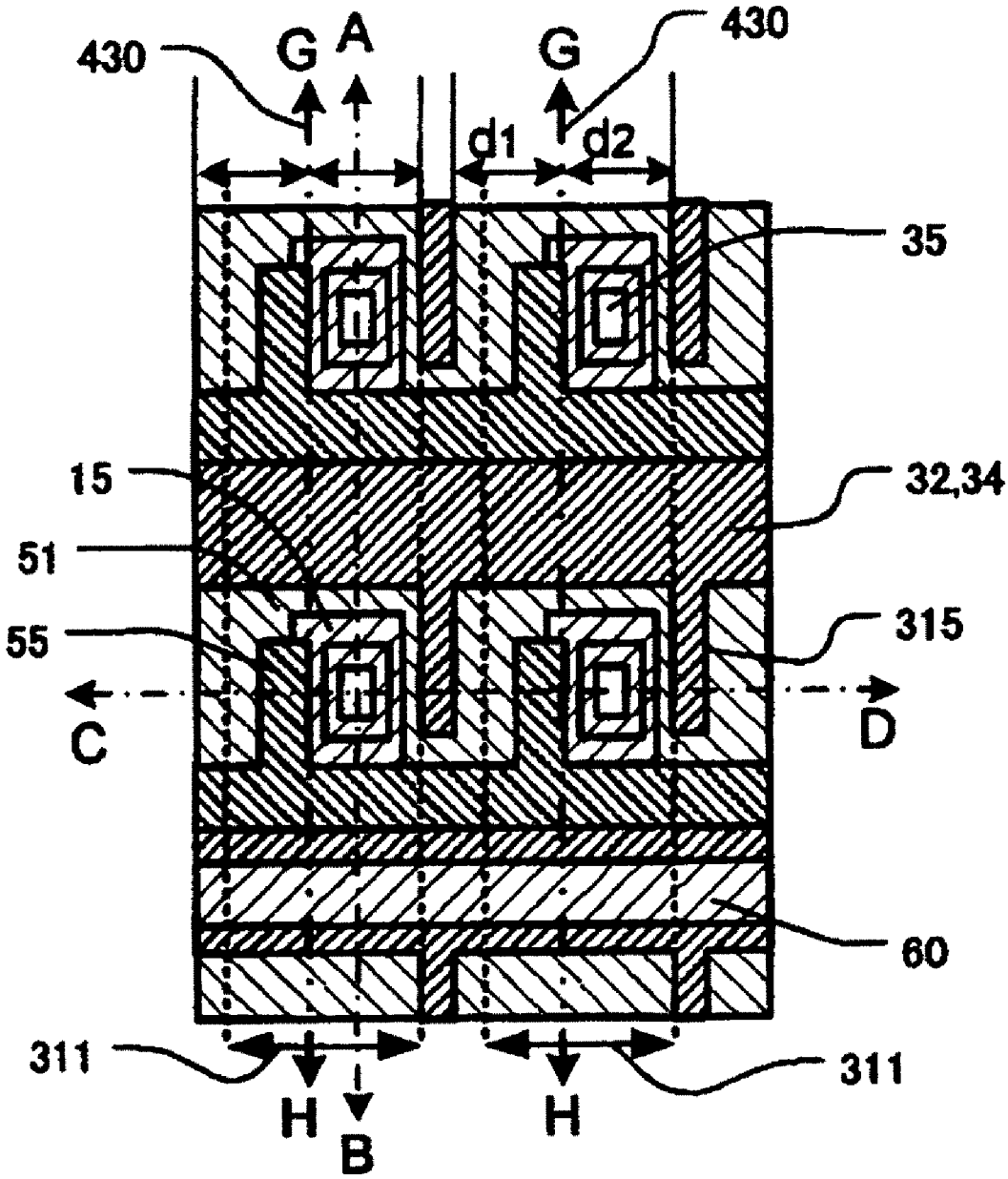
FIG. 13 is a top plan view showing a part of the cathode plate of the second embodiment of the image display apparatus according to the present invention.
Figure 14A:
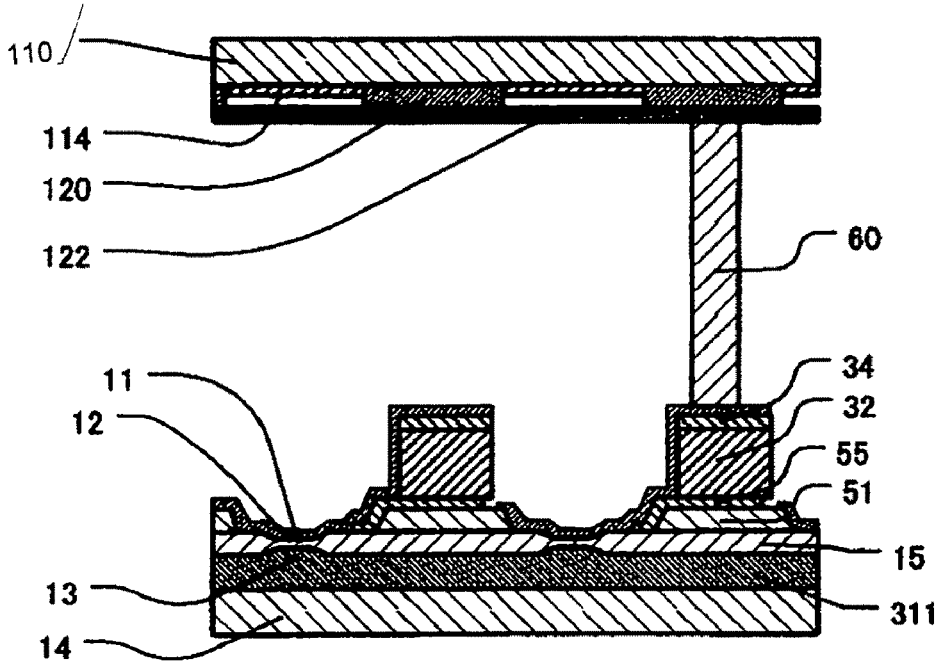
FIG. 14A is a cross section along line A-B of FIG. 13 showing a part of the cathode plate of the second embodiment of the image display apparatus according to the present invention.
Figure 14B:
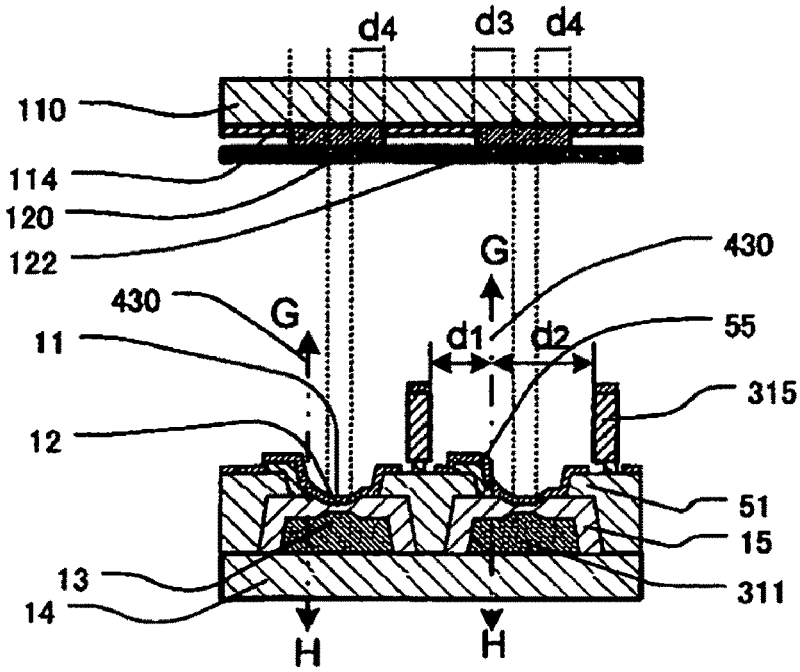
FIG. 14B is a cross section along C-D of FIG. 13 showing a part of the cathode plate of the second embodiment of the image display apparatus according to the present invention.
Figure 15A:
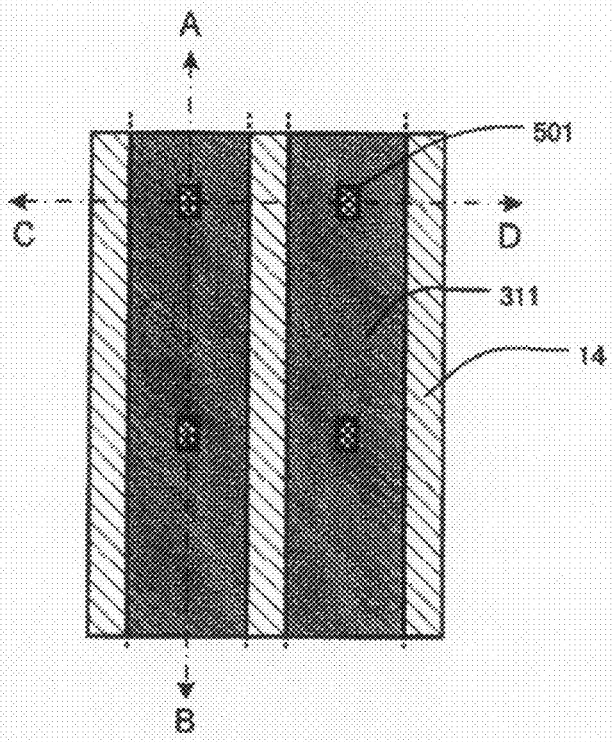
FIG. 15A is a top plan view for explaining a fabrication process of the cathode plate of the second embodiment of the image display apparatus according to the present invention.
Figure 15B:
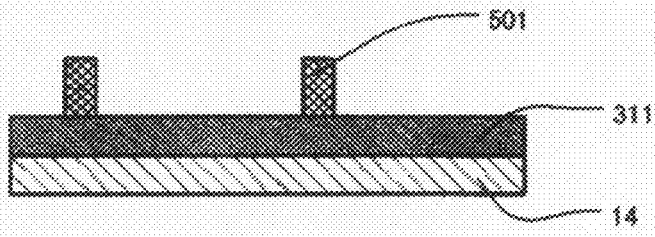
FIG. 15B is a cross section along line A-B of FIG. 15A.
Figure 15C:
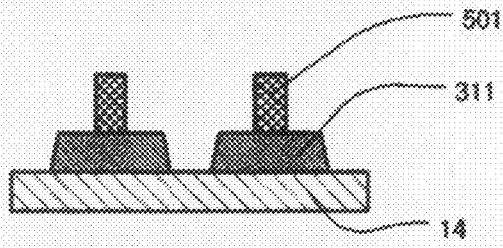
FIG. 15C is a cross section along line C-D of FIG. 15A.
Figure 16A:
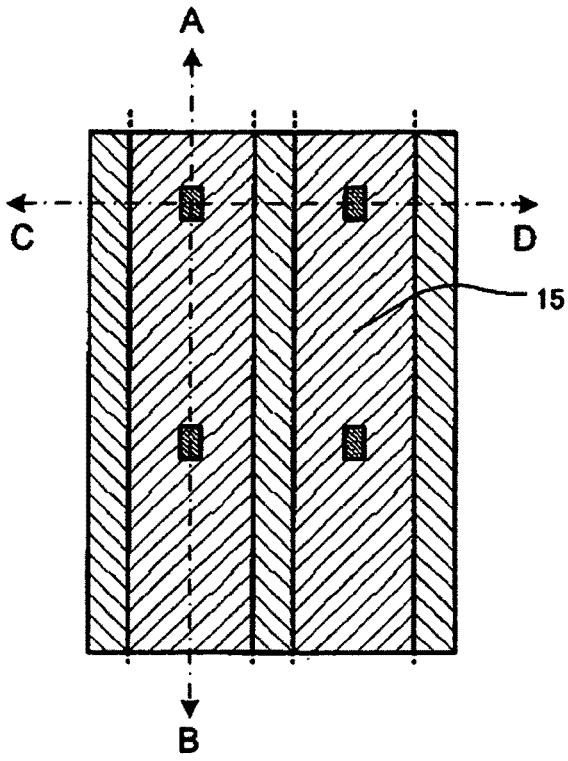
FIG. 16A is a top plan view for explaining a fabrication process of the cathode plate of the second embodiment of the image display apparatus according to the present invention.
Figure 16B:
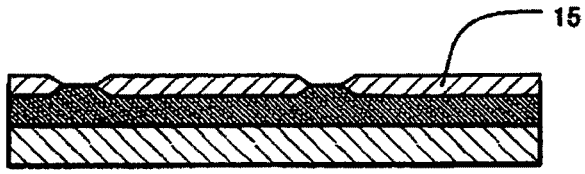
FIG. 16B is a cross section along line A-B of FIG. 16A.
Figure 16C:
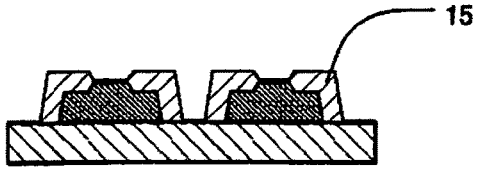
FIG. 16C is a cross section along line C-D of FIG. 16A.
Figure 17A:
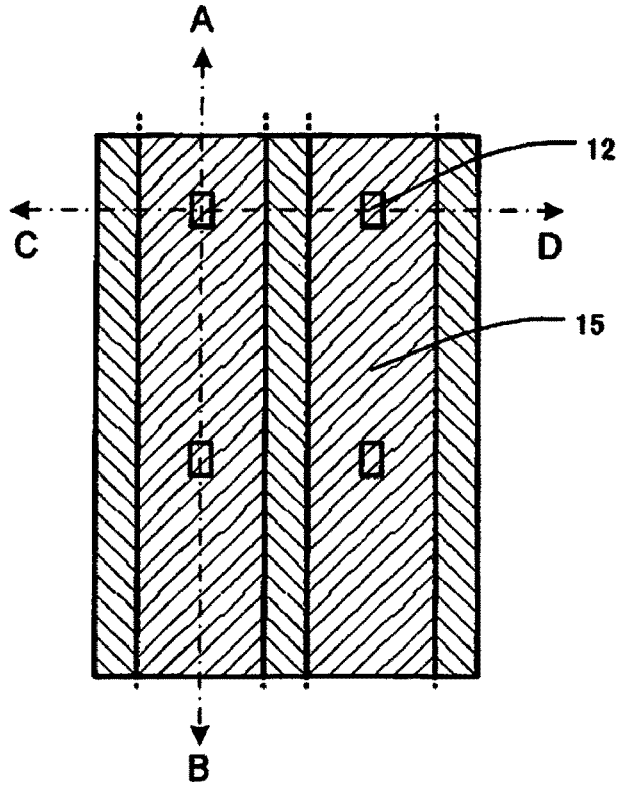
FIG. 17A is a top plan view for explaining a fabrication process of the cathode plate of the second embodiment of the image display apparatus according to the present invention.
Figure 17B:
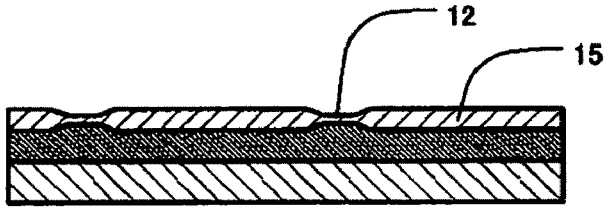
FIG. 17B is a cross section along line A-B of FIG. 17A.
Figure 17C:
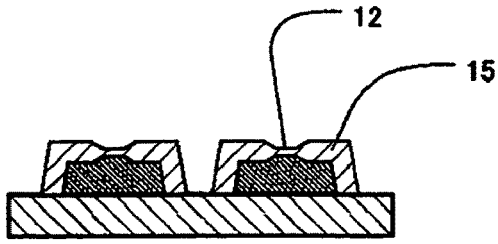
FIG. 17C is a cross section along line C-D of FIG. 17A.

Next, the image display apparatus of the present embodiment will be described more in detail. First, a fabricating method of a display panel 100 constituting the image display apparatus will be described. The display panel 100 is formed of the cathode plate 601 and the phosphor plate 602. FIG. 13 is a top plan view showing a part of the cathode plate 601. In FIG. 13, the sub pixels of 2 rows×2 columns were taken out and illustrated. FIGS. 14A and 14B are cross sections showing a part of the cathode plate 601. A cross section along A-B of FIG. 13 corresponds to FIG. 14A, and a cross section along C-D corresponds to FIG. 14B. FIG. 13 is a top plan view taking off the top electrode 11. In reality, as evident from the cross sections of FIG. 14, the top electrode 11 is deposited as a film on the entire surface.

FIG. 13 describes in detail a specific constitution example in a case when the thin film electron emitter is used as the electron emission element 301 in FIG. 11. Consequently, in FIG. 13, the relation of connection between the electron emission element 301 and the electrode wiring is the same as that in FIG. 11. Hereinafter, the electron emission region 35 corresponding to an electron emission element 301-n will be referred to as an electron emission region 35-n. Now, to describe by using reference numerals of FIG. 11, feeding is made to an electron emission element 301-2 from a scan line 310-2 via the contact electrode 55, and from the adjacent scan line 310-1 (corresponding to a busline electrode 32 in FIG. 13), the deflection electrode 315 is disposed along a longer side of the electron emission region 35-2. In the present embodiment, by electrically connecting the deflection electrode 315 to the scan line 310, an advantage is afforded that the wiring is simplified.

The constitution of the cathode plate 601 is as follows. In FIGS. 14A and 14B, on an insulating substrate 14 such as glass, a thin film electron emitter 301 (electron emission element 301 in the present embodiment) composed of a base electrode 13, an insulating layer 12, and a top electrode 11 is formed. The busline electrode 32 is electrically connected to the top electrode 11 via a contact electrode 55. The busline electrode 32 functions as a feeding line to the top electrode 11. That is, it plays a role of carrying the current to a position of this sub pixel from a drive circuit. Further, in the present embodiment, the busline electrode 32 functions as the scan electrode 310.

In the present embodiment, as the electron emission element 301, a thin film electron emitter is used. As shown in FIG. 14, three of the base electrode 13, a tunneling insulator 12, and the top electrode 11 are the basic constituents of the thin film electron emitter. The electron emission region 35 of FIG. 13 is a place corresponding to the tunneling insulator 12. From the surface of the top electrode 11 over the electron emission region 35, the electron is emitted into vacuum.

In the present embodiment, the region (region contacting the tunneling insulating layer 12) of a part of the data line 311 serves as the base electrode 13. In the present specification, from among the data lines 311, a part contacting the tunneling insulator 12 is referred to as the base electrode 13. In FIG. 13, a threefold rectangular is disposed at a part corresponding to each sub pixel. The rectangular region of the innermost side denotes the electron emission region 35, and this is equivalent to the innermost circumference of a tapered part (slope region) of a first interlayer insulating film 15. The rectangular of its outside is equivalent to the outermost circumference of a tapered film of the first interlayer insulating film 15. Its outside (outermost circumference) is an opening of a second interlayer insulating layer 51.

In the present embodiment, the scan electrode 310 is formed of the bus electrode 32. Further, in the present embodiment, a spacer 60 is provided on the scan electrode 310. The spacer 60 is not required to be provided on all scan electrodes, but may be provided every several scan electrodes. The spacer 60 is electrically connected to the scan electrode 310, and functions to flow the current flowing from the acceleration electrode 122 of the phosphor plate 602 through the spacer 60, and functions to flow electrical charges charged on the spacer 60. In FIGS. 14A and 14B, a contraction scale in height direction is optional. That is, while the base electrode 13, the top electrode, and the like are several μm or less in thickness, a distance between the substrate 14 and a face plate 110 is a length of approximately 1 to 3 mm.

In FIG. 13, a line G-H existing at a position that divides the distance between the inner edges of adjacent deflection electrodes 315 into two equal parts is referred to as a center line 430. That is, in FIG. 13, d1=d2. The electron emission region 35 is disposed so as not to stride the center line 430, and this is the characteristic of the present embodiment.

The fabrication method of the cathode plate 601 will be described with reference to FIGS. 15 to 23. FIGS. 15 to 23 show a process of fabricating the thin film electron emitter on the substrate 14. In these figures, the thin film electron emitters corresponding to the sub pixels of two rows×two columns are shown. A case A (FIGS. 15A-23A) of each figure indicates a top plan view, the cross section along line A-B is shown in a case B (FIGS. 15B-23B), and the cross section along line C-D is shown in a case C (FIGS. 15C-23C).

On the insulating substrate 14 such as glass, an Al alloy is formed, for example, in film thickness of 300 nm as a material of the base electrode 13 (data line 311). Here, Aluminum-Neodymium (Al—Nd) alloy was used. The formation of this Al alloy film employs, for example, a sputtering method or resistive heating evaporation, and the like. Next, this Al alloy film is subjected to resist formation by photolithography and subsequent etching so as to be fabricated in stripe-shaped, thereby forming the base electrode 13. The resist materials employed here may be suitable for etching, and further, etching adapted can be both wet etching and dry etching.

Next, the resist is coated, and is exposed by ultraviolet ray to be patterned, so that a resist pattern 501 of FIG. 15 is formed. For the resist, for example, a quinonediazide based positive resist is used. Next, with the resist pattern 501 attached as it is, anodization is performed, thereby to form a first interlayer insulating film 15. In the present embodiment, this anodization is performed to the extent of anodization voltage of 100V, and the film thickness of the first interlayer insulating film 15 was made to the extent of 140 nm. After that, the resist pattern 501 is removed. This is a state shown in FIGS. 16A-16C.

Next, the surface of the base electrode 13 covered with the resist 501 is anodized so as to form an insulator 12. In the present embodiment, anodization voltage was set to 4V, and the insulator film thickness was made 9.7 nm. This is a state shown in FIGS. 17A-17C. The region in which the insulator 12 is formed becomes the electron emission region 35. That is, the region surrounded by the first interlayer insulating film 15 is the electron emission region 35.

When a film thickness d of an anodization insulating film obtained by anodizing aluminum is thinner in thickness than approximately 20 nm, it is disclosed that a relationship of d(nm)=1.36×(VAO+1.8) is established (Non-Patent Document 3). When the insulator film thickness in a case when an anodization voltage is 4V is determined from this relational formula, it becomes 7.9 nm. However, as a result of measuring by the film thickness by transmission type electron microscope, it was found that the film thickness generated by anodization voltage 4V is 9.7 nm. The above described film thickness value adopts this actual measurement.

Figure 18A:
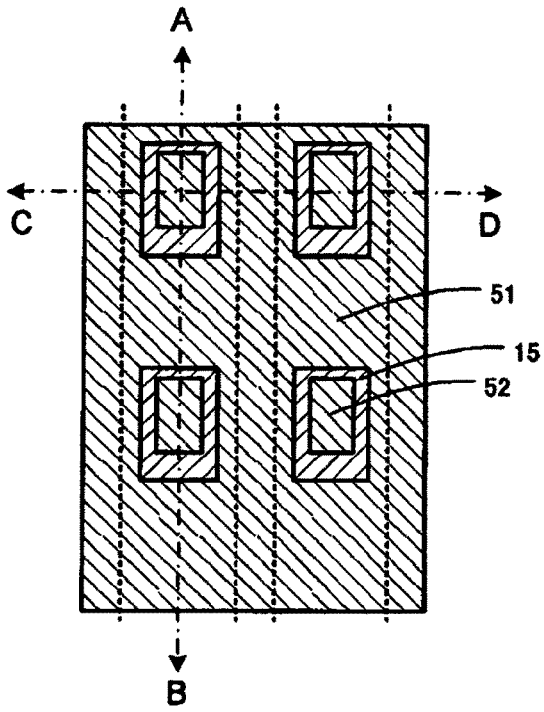
FIG. 18A is a top plan view for explaining a fabrication process of the cathode plate of the second embodiment of the image display apparatus according to the present invention.
Figure 18B:
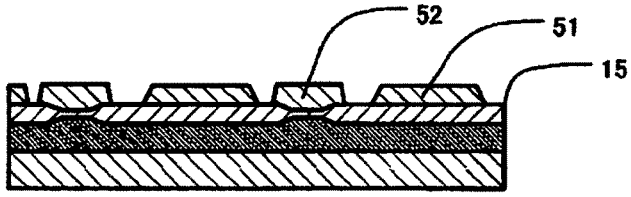
FIG. 18B is a cross section along line A-B of FIG. 18A.
Figure 18C:
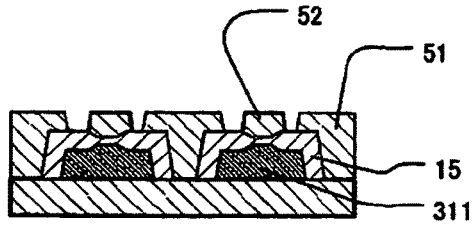
FIG. 18C is a cross section along line C-D of FIG. 18A.

Next, by the following procedure, a second interlayer insulating film 51 and an electron emission region protection layer 52 are formed (FIGS. 18A-18C). A pattern of the second interlayer insulating film 51 is formed at an intersection region with the busline electrode 32 and the data electrode 311, and the second interlayer insulating film 51 has a pattern in which the electron emission region 35 is exposed. However, at the processing stage of FIGS. 18A-18C, the electron emission region 35 is covered with the electron emission region protection layer 52. The second interlayer insulating layer 51 and the electron emission region protection layer 52, after having deposited silicon nitride (SiNx), Silicon Oxide (SiOx), and the like, are patterned by etching. In the present embodiment, silicon nitride film of 100 nm in thickness was employed. Etching is performed by dry etching using an echant consisting essentially of, for example, $CF_4$ and $SF_6$.

The second interlayer insulating film 51 is formed to improve insulation property between the scan electrode and the data electrode. The electron emission region protection layer 52 protects a part (that is, insulator 12) serving as the electron emission region 35 from the process damages at the subsequent processes; and as described later, the electron emission region protection layer 52 is removed at a later process. In the present embodiment, the second interlayer insulating film 51 and the electron emission region protection layer 52 are formed by the same material and the same process.

Figure 19A:
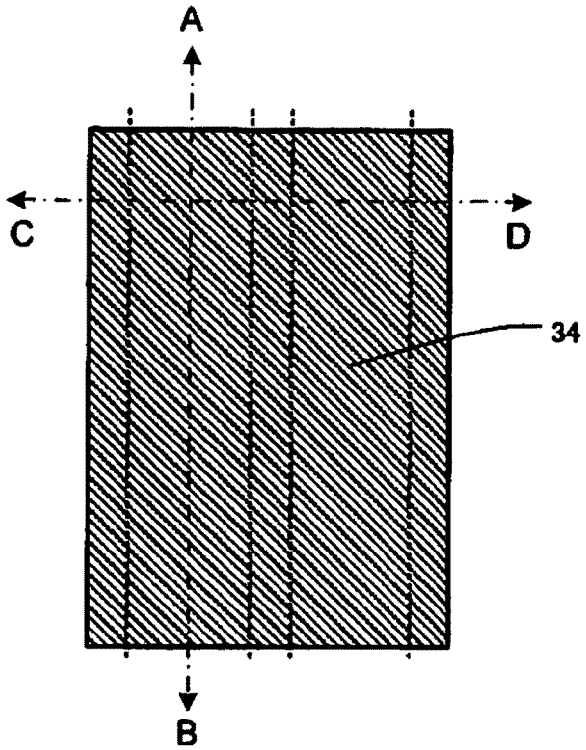
FIG. 19A is a top plan view for explaining a fabrication process of the cathode plate of the second embodiment of the image display apparatus according to the present invention.
Figure 19B:
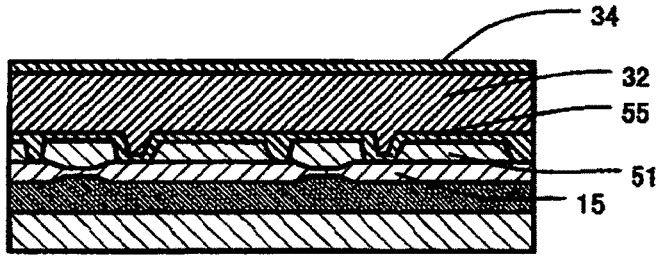
FIG. 19B is a cross section along line A-B of FIG. 19A.
Figure 19C:
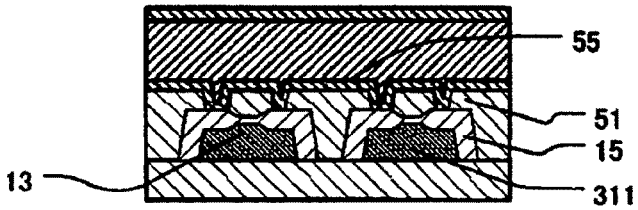
FIG. 19C is a cross section along line C-D of FIG. 19A.

Next, the materials constituting a contact electrode 55, a busline electrode 32, and a busline upper layer 34 are deposited in this order (FIGS. 19A-19C). In the present embodiment, the contact electrode 55 used chrome (Cr) of 100 nm in thickness, the busline electrode 32 used aluminum (Al) of 10 μm in thickness, and the busline electrode upper layer 34 used chrome (Cr) of 200 nm in thickness. These electrodes were deposited by sputtering. The material of the busline electrode 32, when a material having high conductivity is used, becomes low in wiring resistance, and can reduce a voltage drop at the electrode, and therefore, it is preferable.

Figure 20A:
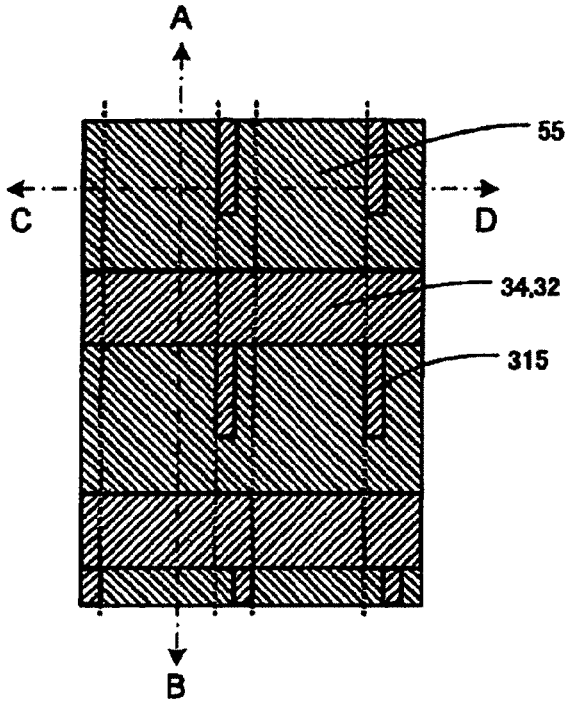
FIG. 20A is a top plan view for explaining a fabrication process of the cathode plate of the second embodiment of the image display apparatus according to the present invention.
Figure 20B:
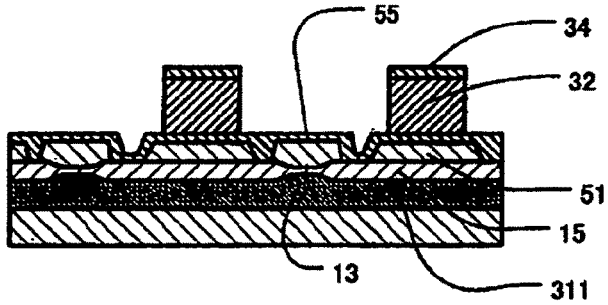
FIG. 20B is a cross section along line A-B of FIG. 20A.
Figure 20C:
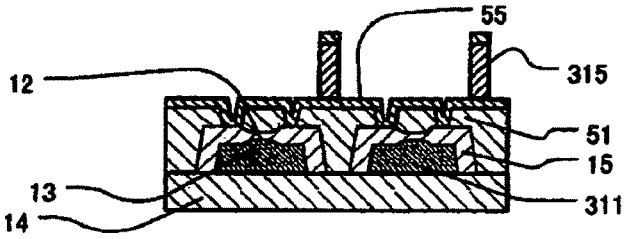
FIG. 20C is a cross section along line C-D of FIG. 20A.

Next, the busline electrode upper layer 34 and the busline electrode 32 are patterned by etching, thereby to form the busline electrode 32 (FIGS. 20A-20C), into a pattern in which the contact electrode 55 is exposed so as to enable the top electrode 11 to connect with the contact electrode 55 in a later step. In this process, a deflection electrode 315 is formed simultaneously. As shown in FIGS. 20A and 20C, by using a pattern provided with a protrusion on the busline electrode 32, the protrusion is used as the deflection electrode 315. That is, the busline electrode 32 and the deflection electrode 315 are made of the same material. By so doing, an advantage is afforded that they can be manufactured by the same manufacturing process as the conventional art.

Figure 21A:
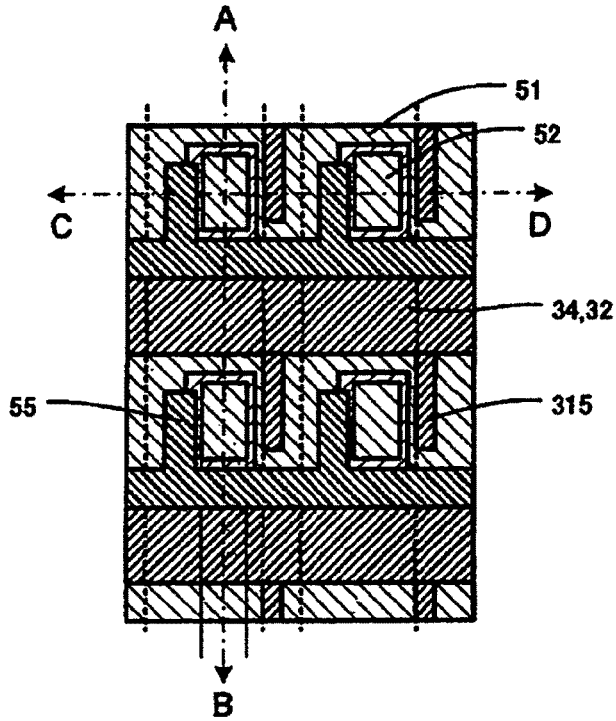
FIG. 21A is a top plan view for explaining a fabrication process of the cathode plate of the second embodiment of the image display apparatus according to the present invention.
Figure 21B:
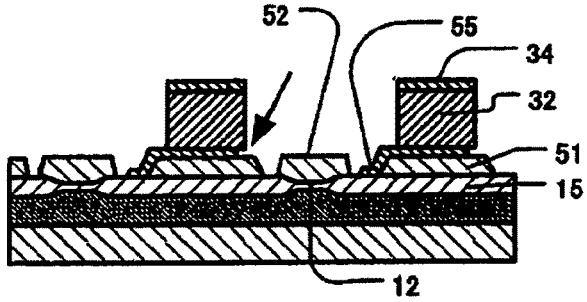
FIG. 21B is a cross section along line A-B of FIG. 21A.
Figure 21C:
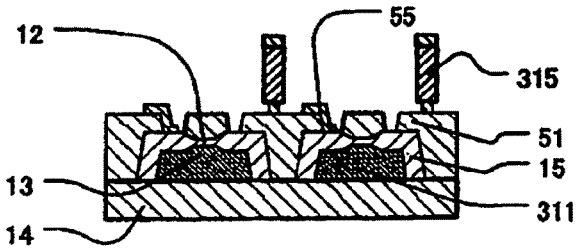
FIG. 21C is a cross section along line C-D of FIG. 21A.

Next, the contact electrode 55 is patterned by etching (FIGS. 21A-21C). Here, the pattern of the contact electrode 55 determines a current feeding state from the contact electrode 55 to the electron emission region 35. As shown in FIG. 21A, the contact electrode 55 is patterned such that, from among four sides of the electron emission region 35, two sides including a longer side are abutted on the contact electrode 55. As described above, the contact electrode region 55 is designed to have a cathode structure in which the current is fed through two sides including a longer side of the electron emission region 35, so that a current feeding ability is improved.

As shown by the arrow mark in the cross section of FIG. 21B, one side (region shown by the arrow mark in the figure) of the contact electrode 55 forms an undercut for the busline electrode 32, and forms an overhang for electrically separating the top electrode 13 in the subsequent process. By presence of this undercut, the top electrodes of the sub pixels connected to the adjacent scan line are mutually electrically insulated (separated). This is referred to as "pixel separation". Since the busline electrode 32 and the deflection electrode 315 are made from the same process, even below the scan electrode 315, the undercut is formed, which is electrically insulated with the adjacent scan line.

An undercut amount of the contact electrode 55 is controlled in the following manner. A part in which the undercut is formed etches the contact electrode 55 by using a side of the busline electrode 32 as a photomask. Consequently, the contact electrode 55 generates the undercut for the busline electrode 32. On the other hand, when the undercut amount is too large, the busline electrode 32 collapses, and this brings the busline electrode 32 into contact with the second interlayer insulating film 51, thereby to eliminate the overhang. Hence, to prevent the formation of an excessively large undercut, a material nobler in standard electrode potential than the material of the busline electrode 32 is used as the material of the contact electrode 55. That is, as the contact electrode 55, the material higher in standard electrode potential than the material of the busline electrode 32 is used.

When the busline electrode is made of aluminum, such a material includes, for example, chrome (Cr), molybdenum (Mo), Cr alloy or the like, and an alloy including these metals as components, for example, Molybdenum-Chrome-Nickel (Mo—Cr—Ni) alloy. By so doing, by local cell mechanism, side etching of the contact electrode 55 is stopped halfway, so that the undercut amount can be prevented from increasing excessively. Further, by controlling the area of the busline electrode to be exposed to the etching liquid, the local cell mechanism can be controlled because the busline electrode material is less nobler material in standard electrode potential. In this way, the stopping position (that is, the undercut amount) of the side etching of the contact electrode 55 can be controlled. For this purpose, the busline electrode upper layer 34 with chrome (Cr) taken as material is formed.

As evident from the above description, the material of the contact electrode 55 preferably uses a nobler (higher) material in standard electrode potential than the material of the busline electrode 32.

Figure 22A:
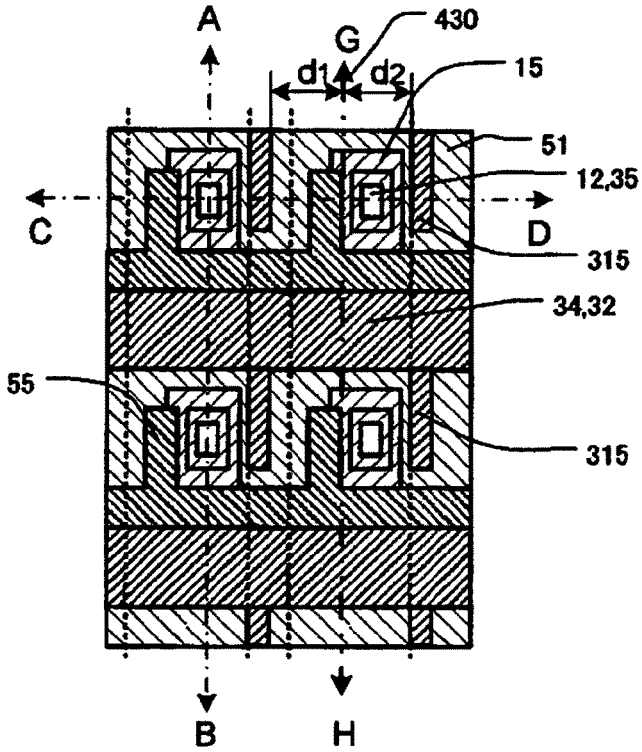
FIG. 22A is a plan view for explaining a fabrication process of the cathode plate of the second embodiment of the image display apparatus according to the present invention.
Figure 22B:
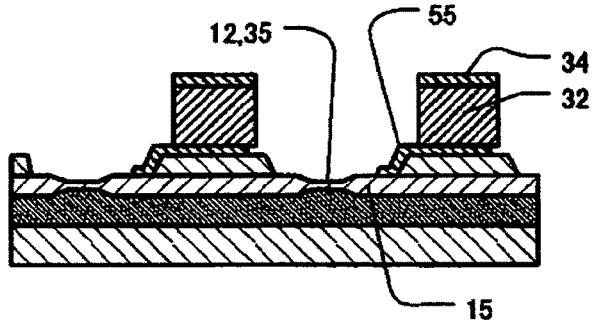
FIG. 22B is a cross section along line A-B of FIG. 22A.
Figure 22C:
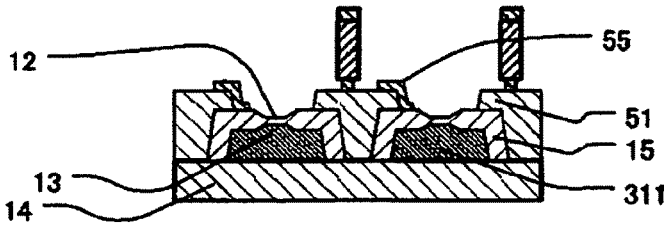
FIG. 22C is a cross section along line C-D of FIG. 22A.
Figure 23A:
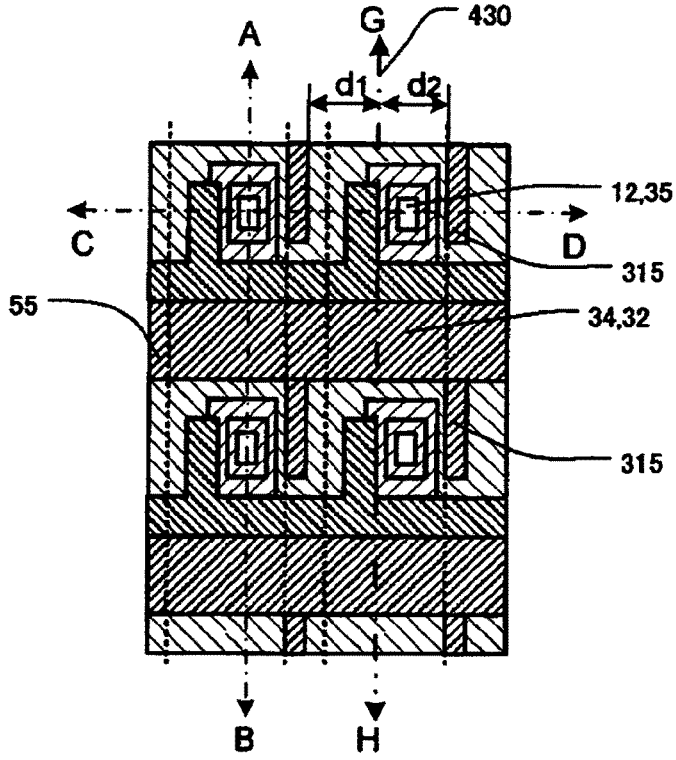
FIG. 23A is a top plan view for explaining a fabrication process of the cathode plate of the second embodiment of the image display apparatus according to the present invention.
Figure 23B:
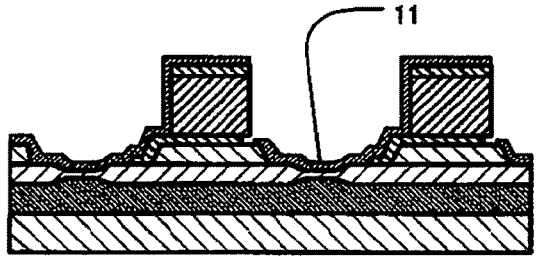
FIG. 23B is a cross section along line A-B of FIG. 23A.
Figure 23C:
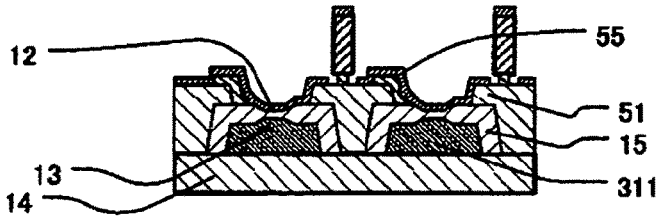
FIG. 23C is a cross section along line C-D of FIG. 23A.

Next, the electron emission region protection layer 52 is removed by dry etching and the like (FIGS. 22A-22C). Next, the top electrode 11 is formed, thereby completing the cathode plate 601 (FIGS. 23A-23C). In the present embodiment, as the top electrode 11, a stacked film of iridium (Ir), platinum (Pt), gold (Au) was used. The top electrode 11 was formed by sputtering deposition. Although the entire surface is actually deposited with the top electrode 11, for the purpose of explaining the structure simply, FIG. 23A shows a view in which the top electrode is removed. Further, the position of the data line 311 is shown by dotted line.

As shown in FIGS. 23A-23C, the electric current is supplied from the busline electrode 32 severing as a feeding line to the top electrode 11 of the electron emission region 35 via the contact electrode 55. On the other hand, as described above, since the contact electrode 55 is formed with an appropriate amount of the undercut, they are mutually insulated electrically between the scan electrodes 310.

In the present embodiment, a cathode structure in which two features are taken in, is adopted; a feature (feature "A") that two sides including a longer side of the electron emission region are used as a feed path to the top electrode 11 in the electron emission region 35 from the busline electrode 32, and a feature (feature "B") that a step in the second interlayer insulating film is removed from the feed path to the top electrode in the electron emission region.

The constitution of a phosphor 602 is as follows. As shown in FIG. 14, a transparent faceplate 110 such as glass is formed with a black matrix 120, and further, on a position facing each electron emission region, the phosphor 114 is formed. In the case of the color image display apparatus, as the phosphor 114, a red phosphor, a green phosphor, and a blue phosphor are patterned. Further, the acceleration electrode 122 is formed. The acceleration electrode 122 is formed of an aluminum film of approximately 70 nm to 100 nm in thickness. The electron emitted from the thin film electron emitter 301 is accelerated by acceleration voltage applied to the acceleration electrode 122, and after that, when the electron enters the acceleration electrode 122, it pass through the acceleration electrode and bombards the phosphor 114, thereby to excite the phosphor to emit light. The detail of the fabrication method of the phosphor plate 602 is disclosed, for example, in Japanese Patent Application Laid-Open Publication No. 2001-83907.

As shown in FIG. 10, in the present embodiment, since the trajectory of the emitted electron is deflected, a position of the phosphor region 114 is not placed directly above the electron emission region 35, but is disposed in consideration of a deflected amount of the beam. That is, the center position of the electron emission region 35 and the center position of the phosphor region 114 are shifted to each other. Between the cathode plate 601 and the phosphor plate 602, a suitable number of spacers 60 are disposed. As shown in FIG. 1, the cathode plate 601 and the phosphor plate 602 are sealed by interposing or holding a frame component 603. Further, the space surrounded by the cathode plate 601, the phosphor plate 602, and the frame component 603 are pumped to vacuum. By the above described procedure, the display panel is completed.

Figure 24:
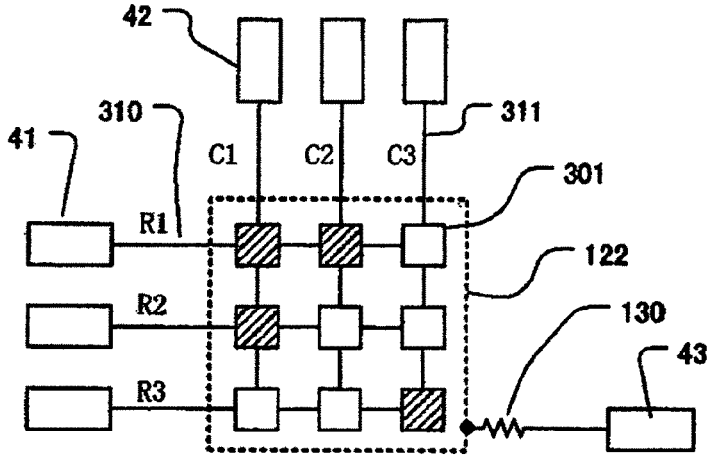
FIG. 24 is a view showing a connection of the display panel and the drive circuit of the second embodiment of the image display apparatus according to the present invention.

FIG. 24 is a connection diagram toward the drive circuit of the display panel 100 fabricated in this manner. The scan electrode 310 is connected to a scan electrode drive circuit 41, and the data electrode 311 is connected a data electrode drive circuit 42. The acceleration electrode 122 is connected to an acceleration electrode drive circuit 43 through a resistor 130. A dot at the intersection of an n-th scan electrode 310Rn and an m-th data electrode 311Cm is represented by (n, m).

A resistance value of the resistor 130 was set as follows. For example, in the display apparatus having a diagonal size of 51 cm (nominal 20 inches), a display area is 1240 $cm^2$. When the distance between the acceleration electrode 122 and the cathode is set to 2 mm, a capacitance Cg between the acceleration electrode 122 and the cathode is about 550 pF. To make a time constant sufficiently longer than occurrence time (approximately 20 nano seconds) of vacuum discharge, for example, 500 nano seconds, it is sufficient to set a resistance value Rs of the resistor 130 at 900Ω or more. In the present embodiment, the value was set to 18 KΩ (time constant 10 μs). In this manner, by inserting a resistor having the resistance value to satisfy the time constant Rs×Cg>20 ns between the acceleration electrode 122 and the acceleration electrode drive circuit 43, an effect of suppressing an occurrence of the vacuum discharge inside the display panel can be obtained.

Figure 25:
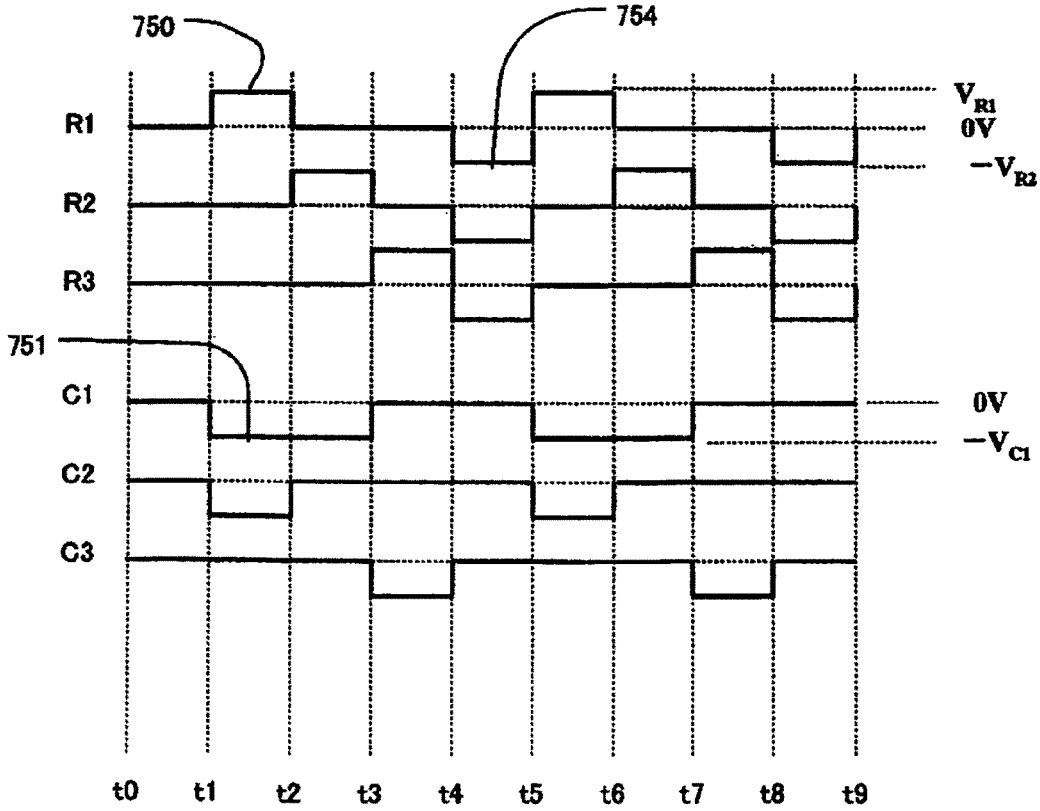
FIG. 25 is a view showing a drive waveform of the second embodiment of the image display apparatus according to the present invention.

FIG. 25 shows a waveform of the generated voltage of each drive circuit. Although not illustrated in FIG. 25, the acceleration electrode 122 is applied with the voltage (phosphor screen voltage Va) of approximately 3 to 10 KV. At the time t0, since voltage of any of the electrodes is zero, no electron is emitted, and consequently, the phosphor 114 does not emit light.

At the time t1, a scan pulse 750 of the voltage which is $V_{R1}$=Vs is applied to the scan electrode 310R1, and the scan electrode is thereby put into a selection state. The non-selected scan electrodes, that are the scan electrodes other than the selected scan electrode 310R1, are supplied with a voltage which is Vns. In the present embodiment, Vns=0V. Further, at the time t1, a data pulse 751 of a voltage which is $-V_{C1}$, is applied to data electrodes 311C1 and 311C2. Between the base electrode 13 and the top electrode of dots (1, 1) and (1, 2), a voltage which is ($V_{C1}+V_{R1}$) is applied, and therefore, if ($V_{C1}+V_{R1}$) is set to equal to or higher than the voltage of starting an electron emission (a threshold voltage of electron emission), the electron is emitted into vacuum 10 from the thin film electron emitter of these two dots.

In the present embodiment, $V_{R1}$=VS=+4V and $-V_{C1}$=−3V. The emitted electron is accelerated by the voltage applied to the acceleration electrode 122, and after that, bombards the phosphor 114, thereby to excite the phosphor 114 to emit light. At the time t2, when a voltage which is $V_{R1}$=VS is applied to a scan electrode 310R2, and a voltage which is $-V_{C1}$, is applied to a data electrode 311C1, similarly the dots (2, 1) are lighted. In this manner, when the voltage waveform of FIG. 25 is applied, only the dots marked with shaded lines in FIG. 24 are lighted.

In this manner, it is possible to display a desired image or information by changing the signal applied to the data electrode 311. Further, by suitably changing magnitude of the voltage $-V_{C1}$ applied to the data electrode 311 according to the image signal, an image with gradation can be displayed.

As shown in FIG. 25, at the time t4, a voltage which is $-V_{R2}$ is applied to all the scan lines 310. In the present embodiment, $-V_{R2}$=−3V. At this time, since the applied voltage to all the data electrodes 311 is 0V, a voltage of $-V_{R2}$=−3V is applied to the thin film electron emitter 301. In this way, a voltage whose polarity is reverse to the voltage applied during electron emission is applied; the reverse polarity pulse is called reverse pulse 754. By applying a reverse polarity voltage, electrical charges accumulated in traps in the insulating layer 12 are liberated, and it is possible to improve a lifetime characteristic of a thin-film electron emitter. Further, if the vertical blanking period of a video signal is used as a period of applying the reverse pulse (t4 to t5 and t8 to t9 of FIG. 25), consistency with the video signal is good. In the description of FIGS. 24 and 25, for the sake of simplicity, a description has been made by using an example of 3×3 dots. However, in the actual image display apparatus, the number of scan electrodes is several hundreds to several thousands, and the number of data electrodes is also several hundreds to several thousands.

Figure 26:
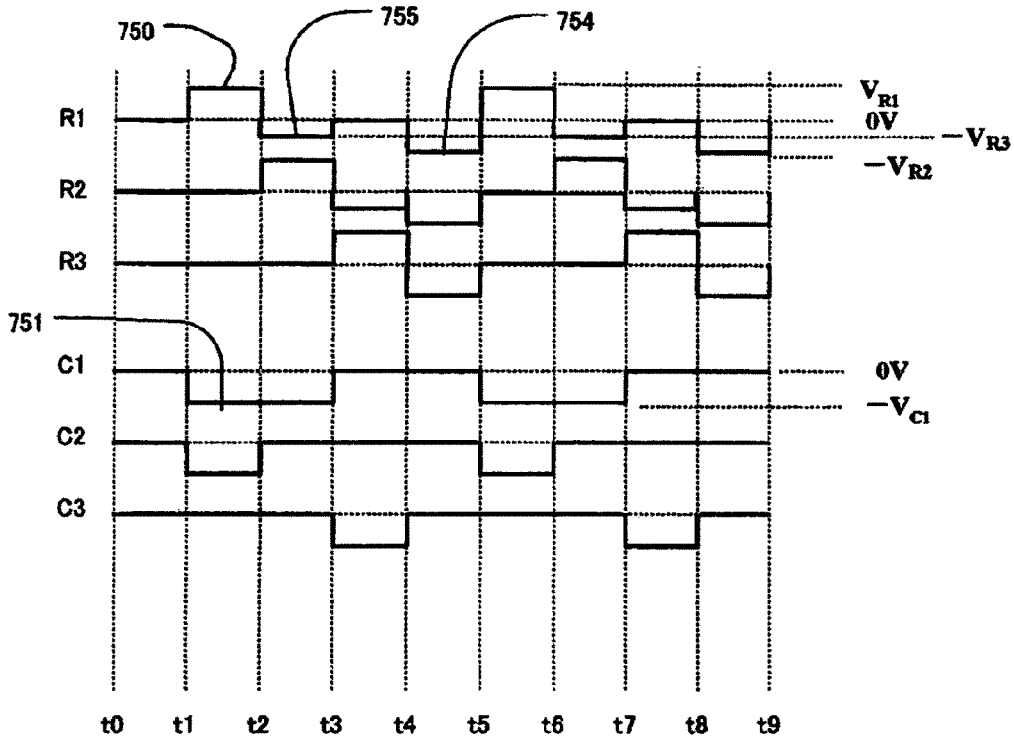
FIG. 26 is a view showing a drive waveform of another embodiment of the image display apparatus according to the present invention.

FIG. 26 shows another driving method. In this driving method, in the period of the time t2 to t3, the scan pulse 750 is applied the scan electrode 310R2, and a deflection pulse 755 is applied to the scan electrode 310R1 adjacent to the electron emission element connected to the scan electrode 310R2. The voltage of the deflection pulse is taken as Vdef=$-V_{R3}$. In this manner, by setting the voltage of the deflection electrode 315 suitably, a voltage relation among the deflection electrode 315, the contact electrode 55, and the top electrode 11 is optimized, thereby making it possible to obtain a higher beam deflection effect.

As evident from FIG. 10, an electron lens that deflects an electron beam trajectory is affected by the voltage of phosphor screen, the voltage of the deflection electrode, and the voltage of the top electrode. The voltage between the top electrode and the defection electrode at the electron emission time is (Vs−Vns) in the driving method of FIG. 25, and is (Vs−Vdef) in the driving method of FIG. 26. As a result of having performed an electron trajectory simulation, it is shown that the larger (Vs−Vdef) is, the larger the beam deflection amount is. Consequently, when the beam deflection amount is desired to be increased, it is preferable to make the absolute value of (Vs−Vdef) larger than the absolute value of (Vs−Vns). Further, as the more preferred embodiment, the voltage $-V_{R3}$ of the deflection pulse 755 is set equal to the voltage $-V_{R2}$ of the reverse pulse 754. When the setting is made in this manner, the drive circuit is simplified, and this is more preferable.

As more preferable mode of the present embodiment, the relation between the phosphor region 144 and the electron emission region 35 will be described. As described above, since the phosphor is a place in which the positive ion is easily generated, when the phosphor region 144 is disposed so as not to be mutually superposed with the electron emission region 35 in a projected plane, the generation of the positive ion and its irradiation to the electron emission region can be further reduced, and therefore, this is more preferable. That is, in FIG. 10, designing such that d3>0 and d4>0 is more preferable. The condition [d3>0] is a condition in which the phosphor region 144 corresponding to the electron emission region is not superposed with the electron emission region, and the condition [d4>0] is a condition in which the adjacent phosphor region 144 is not superposed with the electron emission region.

In the present embodiment, the deflection electrode 315 uses the same material as the scan line 310 (that is, the busline electrode 32), and is patterned simultaneously in the same photolithographic processes. By so doing, even when the deflection electrode is introduced, it can be fabricated by the same fabrication process as the conventional art without increasing the number of photomasks, and this is preferable.

Third Embodiment

Figure 27:
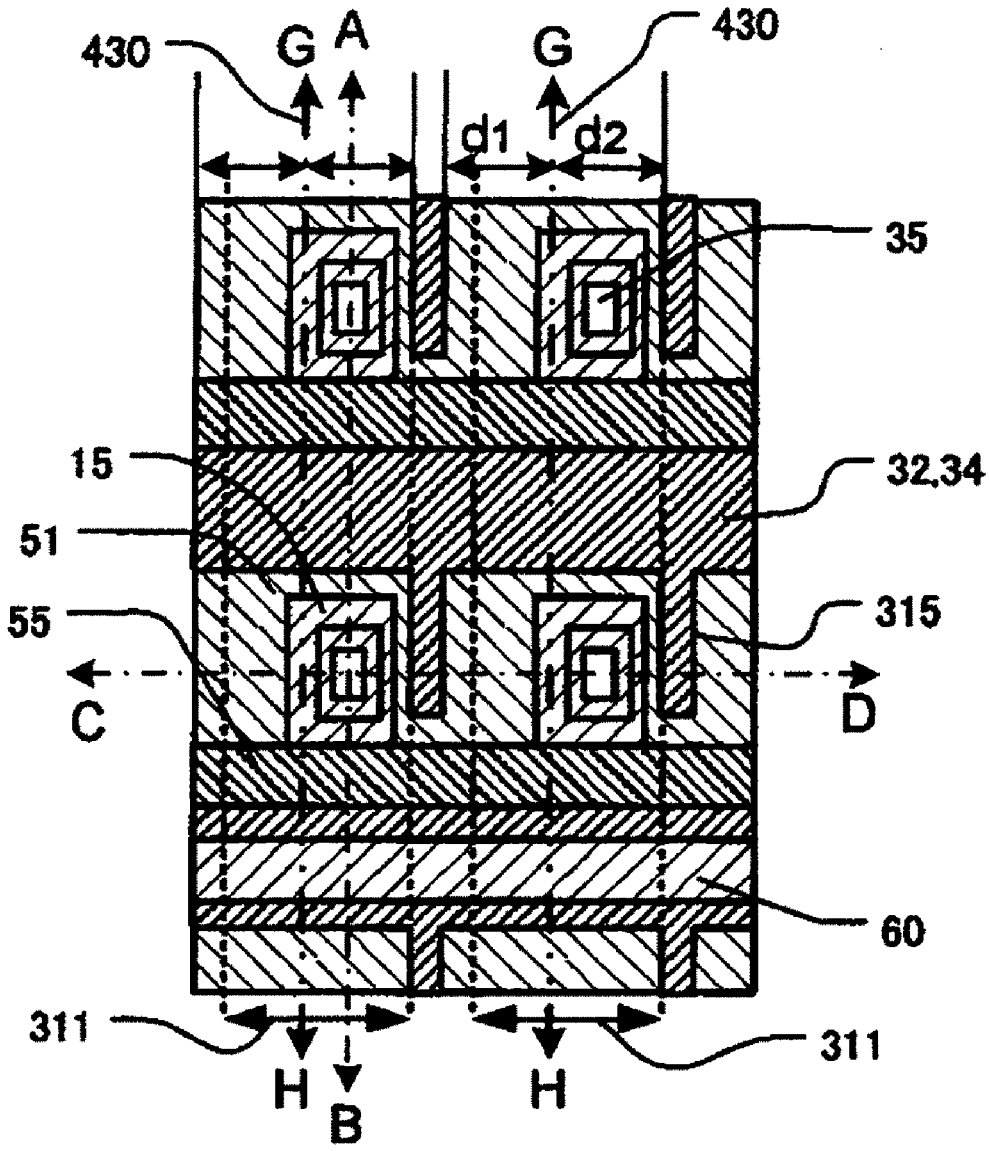
FIG. 27 is a top plan view showing a part of the cathode plate of a third embodiment of the image display apparatus according to the present invention.
Figure 28A:
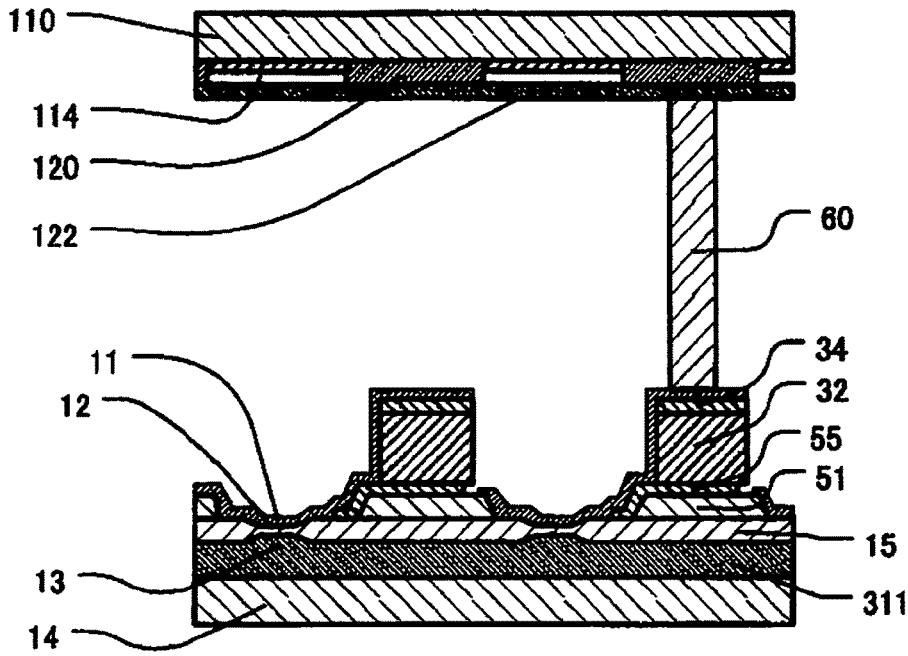
FIG. 28A is a cross section along A-B of FIG. 27 showing a part of the cathode plate of a third embodiment of the image display apparatus according to the present invention.
Figure 28B:
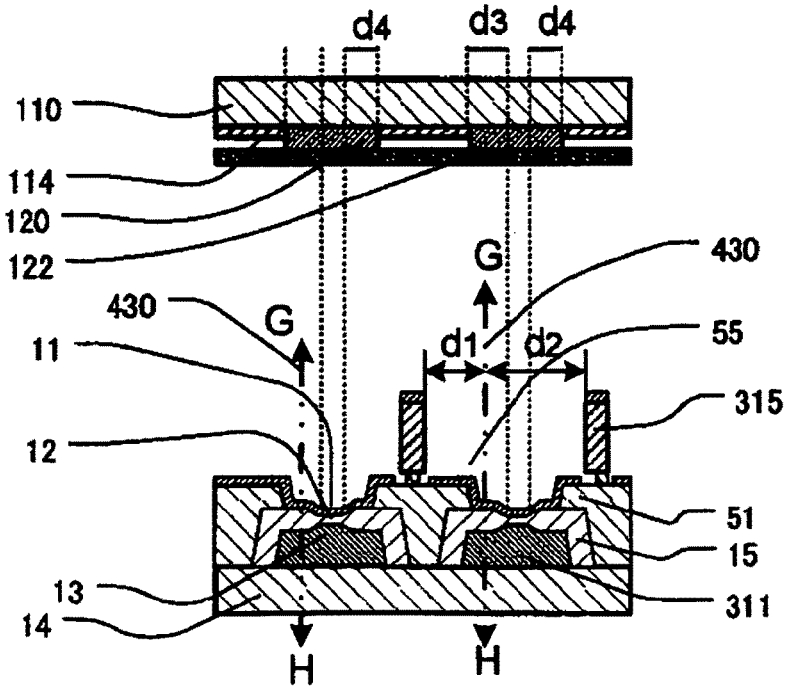
FIG. 28B is a cross section along C-D of FIG. 27 showing a part of the cathode plate of a third embodiment of the image display apparatus according to the present invention.

A third embodiment of the present invention will be described with reference to FIGS. 27 and 28A-28B. FIG. 27 is a top plan view of a cathode plate 601 constituting a display panel 100 used in the present embodiment. FIGS. 28A and 28B are cross section of the cathode plate 601, FIG. 28A is a cross section along line A-B of FIG. 27, and FIG. 28B shows a cross section along line C-D. When comparing the third embodiment with the second embodiment (FIGS. 13 and 14A-14B), the shape of a contact electrode 55 is different in the present embodiment. While the contact electrode 55 has a branch-shaped protrusion extending along the longer side of the electron emission region 35 in FIG. 13, the protrusion is not available in the present embodiment (FIG. 27).

As evident from FIG. 28B, a top electrode 11 is formed almost entirely on the surface except for a scan electrode 310 (that is, a busline electrode 32) and a deflection electrode 315. Since the film thickness (0.1 μm in the present embodiment) of the contact electrode 55 is 1/100 of the film thickness of 10 μm of a deflection electrode 315, the shape of the contact electrode is hardly affected by electric field distribution near an electron emission region 35. Consequently, even by the electrode shape of FIGS. 27 and 28, the beam deflection effects similar to the preceding embodiments can be obtained.

In the present embodiment (FIG. 27), since the shape of the contact electrode is simple, it has the advantage of being easily manufactured. In particular, when the contact electrode is patterned, there is no need for high accuracy in mask alignment in a lateral direction, it can be easily fabricated. On the other hand, the contact electrode shape of FIG. 13 has the advantages of being high in current feeding ability and increasing electron emission efficiency and reliability of thin film electron emitter. This will be described with reference to FIGS. 29A and 29B. The contact electrode 55 has a role of electrically connecting the scan line 310 (which is formed of a busline electrode 32 in the present embodiment) and the top electrode 11. In the thin film electron emitter, though the entire electron emission region 35 is required to be fed with the current, since the thickness of the top electrode 11 is thin such as approximately 10 nm or less, the resistance is high. Hence, the current is fed through the contact electrode 55 which is approximately 100 nm in film thickness and is, therefore, small in electrical resistance.

Figure 29A:
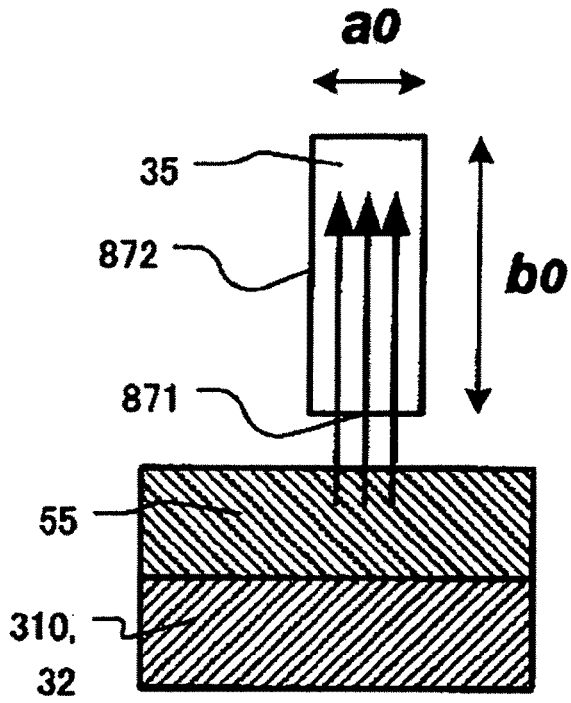
FIG. 29A is a view for explaining a current feeding ability by a contact electrode shape, and corresponds to the embodiment of FIG. 27.
Figure 29B:
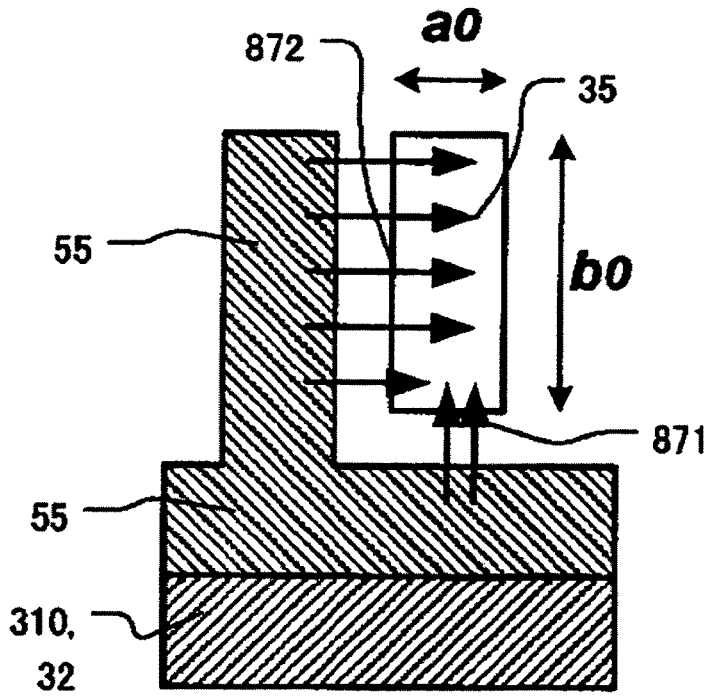
FIG. 29B is a view for explaining a current feeding ability by a contact electrode shape, and corresponds to the embodiment of FIG. 13.

The relation between the contact electrode shape and the current feeding ability will be described with reference to FIGS. 29A and 29B. FIGS. 29A and 29B schematically show the disposition of the electron emission region 35, the contact electrode 55, and the scan electrode 310 (formed of the busline electrode 32 in the present embodiment). FIG. 29A corresponds to the embodiment of FIG. 27, and FIG. 29B corresponds to the embodiment of FIG. 13.

In the contact electrode shape of FIG. 29A, since the current is fed from a single side 871 only of the electron emission region 35, the current builds up in the single side 871, and density of the current that flows to the top electrode 11 is relatively high. On the other hand, in the contact electrode shape of FIG. 29B, since the current is fed from two sides 871 and 872 of the electron emission region 35, the current is scattered. Hence, the density of the current that flows to the top electrode 11 is reduced. Accordingly, the resistance value required for the top electrode can be higher. Hence, it is possible to make the top electrode film thickness thinner. When the top electrode is made thinner, inelastic scattering of hot electron inside the top electrode is reduced, so that the electron emission efficiency is increased. Further, as the current is scattered, reliability of the connection between the contact electrode and the top electrode is improved.

In the color image display apparatus, in many cases, the sub-pixels of red color, green color, and blue color are disposed in the lateral direction, thereby constituting one pixel. Since one pixel is approximately square, the shape of each sub-pixel is normally vertically long. In response to this, the shape of the electron emission region 35 corresponding to each sub pixel is also made vertically long. For this reason, in the color image display apparatus, a ratio of b0/a0 of FIG. 29 is normally larger than 1, and it is typically 2 to 3. Hence, in FIG. 29(*a*), the current builds up in the shorter side of the electron emission region 35. In FIG. 29(*b*), since the current is fed also from the longer side of the length b0, the current is scattered. In this manner, when the contact electrode 55 is disposed along the longer side of the electron emission region 35, the current density that flows in the top electrode is reduced, and this is more preferable.

Fourth Embodiment

Figure 31:
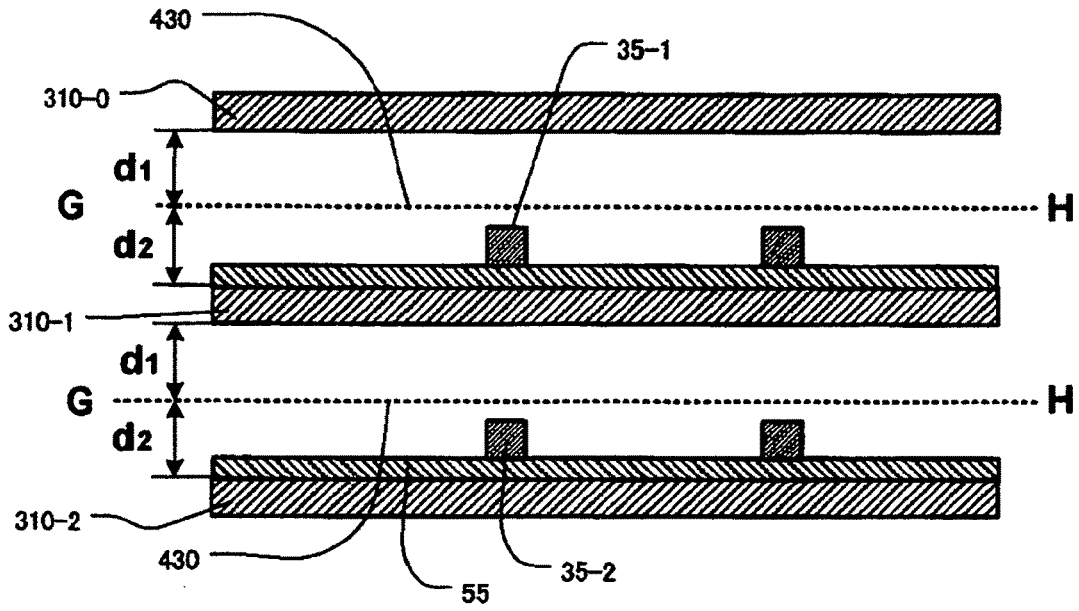
FIG. 31 is a view showing a part of the cathode plate of a fourth embodiment of the image display apparatus according to the present invention.

A fourth embodiment of the present invention will be described with reference to FIG. 31. The present embodiment uses a thin film electron emitter as an electron emission element. FIG. 31 is a top plan view of the cathode plate 601 constituting the display panel 100, and shows main constituent components only. FIG. 31 corresponds to FIG. 11 of the above described embodiment. In FIG. 31, a scan line 310, a contact electrode 55, and an electron emission region 35 of each electron emission element 301 only are described from among the constituent components constituting a cathode plate 601. An electron emission region 35-2 is electrically connected to a scan line 310-2 via the contact electrode 55.

In the present embodiment, the film thickness of the scan line 310 is taken as 6 μm in thickness, so that a height of the scan line 310 is made sufficiently higher than a height of a top electrode, and the scan line 310 is allowed to perform also the function as a deflection electrode. As shown in FIG. 31, an electron emission region 35 is disposed so as not to include a center line G-H 430 of the distance of the inner edges between adjacent scan lines. By so doing, the electron emitted from the electron emission region is vertically deflected (in the figure).

Figure 30A:
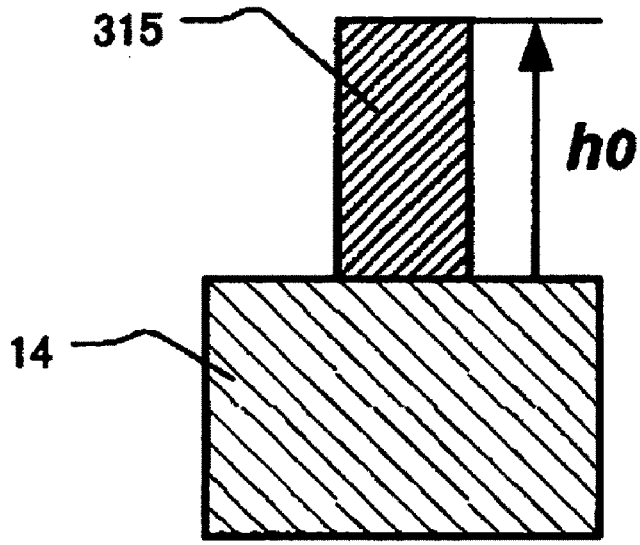
FIG. 30A is a view for explaining a definition of a height in the present specification.
Figure 30B:
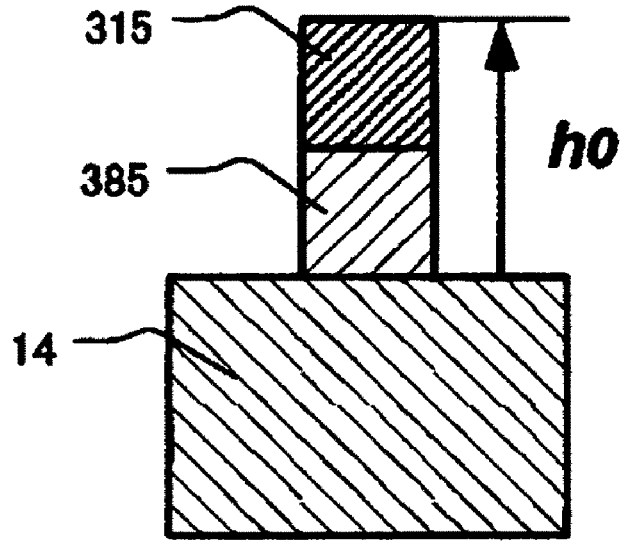
FIG. 30B is a view for explaining a definition of a height in the present specification.

Here, the "height" of the electrode is a value defined by FIG. 30 as described above. That is, similarly to FIG. 30A, when a substrate 14 is directly formed with a deflection electrode 315, its film thickness becomes a height h0. Further, similarly to FIG. 30B, when the deflection electrode 315 is formed on a dielectric layer 385, a length (h0 in the figure) up to the highest position of the deflection electrode 315 defines the height. In FIGS. 30A and 30B, while the height of the deflection electrode 315 is shown, the height of the scan line 310 is defined by rereading the deflection electrode 315 into the scan line 310 in FIGS. 30A and 30B. Even in the case such as FIG. 30B, the height h0 mainly controls electron lens characteristics.

In the present embodiment, without providing a protrusion of the deflection electrode 315 such as FIG. 11 in the scan line 310, the height of the scan line 310 itself is utilized so as to allow it to have the function of the deflection electrode. When compared with the second embodiment, the wiring pattern is simple, and therefore, an advantage is afforded that the deflection electrode is easy to manufacture.

On the other hand, in the second embodiment, as shown in FIG. 11, the deflection electrode 315 is periodically disposed along the axis in parallel with the scan line 310. That is, while the deflection electrode 315 is periodically disposed, this repeating direction is in parallel with the scan line 310. As a result, the electron beam, as shown in FIG. 10, is deflected in the direction parallel to the scan line 310. The main advantages of allowing the beam to deflect into this direction have two points as follows.

The first point is that a distance (period) between the adjacent deflection electrodes 315 are short. The shorter the distance between the deflection electrodes 315 is, the more increased the effect of the electron lens is, and therefore, the deflection amount of the electron beam is increased. Hence, the effect of ion irradiation can be reduced. As described above, in the color image display apparatus, since there are many cases where the sub-pixel is disposed in the horizontal direction, it is more preferable that the deflection electrode 315 is periodically disposed along the axis in parallel with the scan line 310 as shown in FIG. 11, so that the distance between the deflection electrodes is made shorter.

The second point is that the electron beam is deflected in the direction parallel to the spacer 60, and this is preferable in preventing an electrical charging of the spacer. When the spacer 60 is charged, the electric field inside the display panel is distorted, and this sometimes causes the electron beam to deviate from a desired path or route, thereby adversely affecting the display image. If the deflection direction of the electron beam is in a direction parallel to the spacer 60, the spacer 60 can be prevented from being charged. In a typical display panel, as shown in FIG. 13, the spacer 60 is disposed in the direction parallel to the scan line 310 (busline electrodes 32 and 34). Therefore, similarly to FIG. 11, the deflection electrode 315 is periodically disposed along the axis in parallel to the scan line 310, so that the direction of the beam deflection is in the direction parallel to the spacer 60.

Fifth Embodiment

Figure 32:
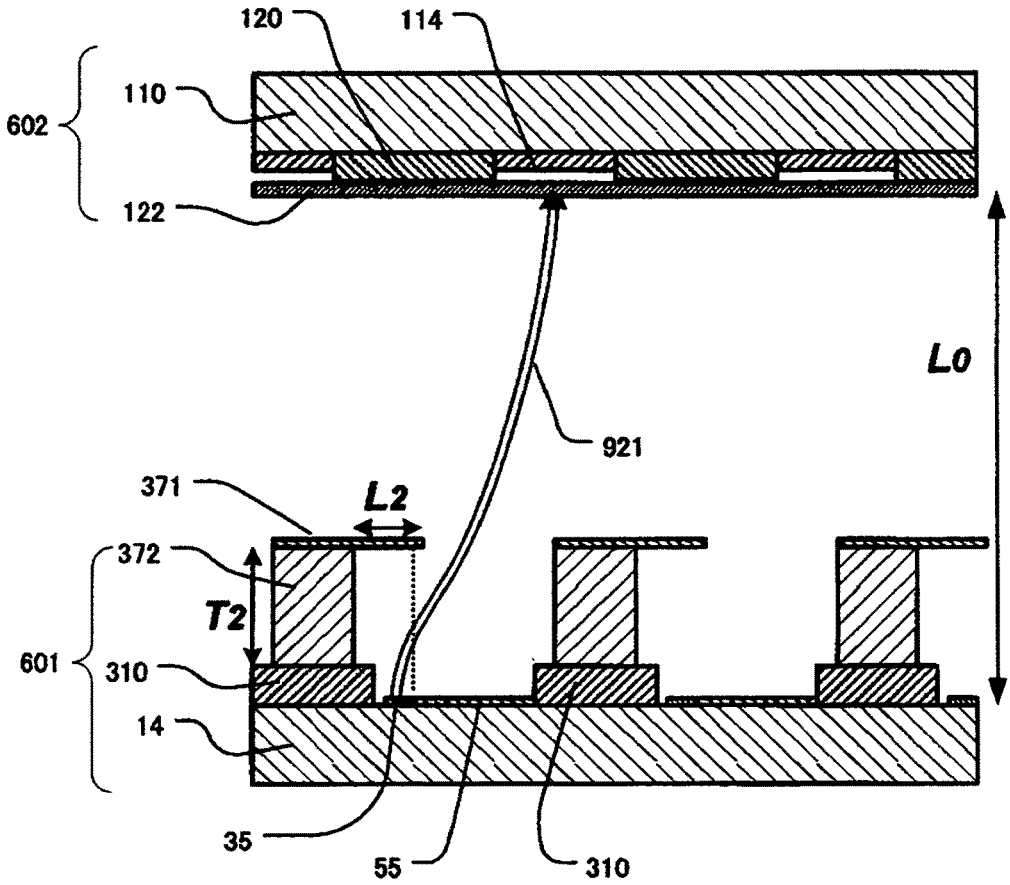
FIG. 32 is a cross section showing a part of the cathode plate of a fifth embodiment of the image display apparatus according to the present invention.
Figure 33:
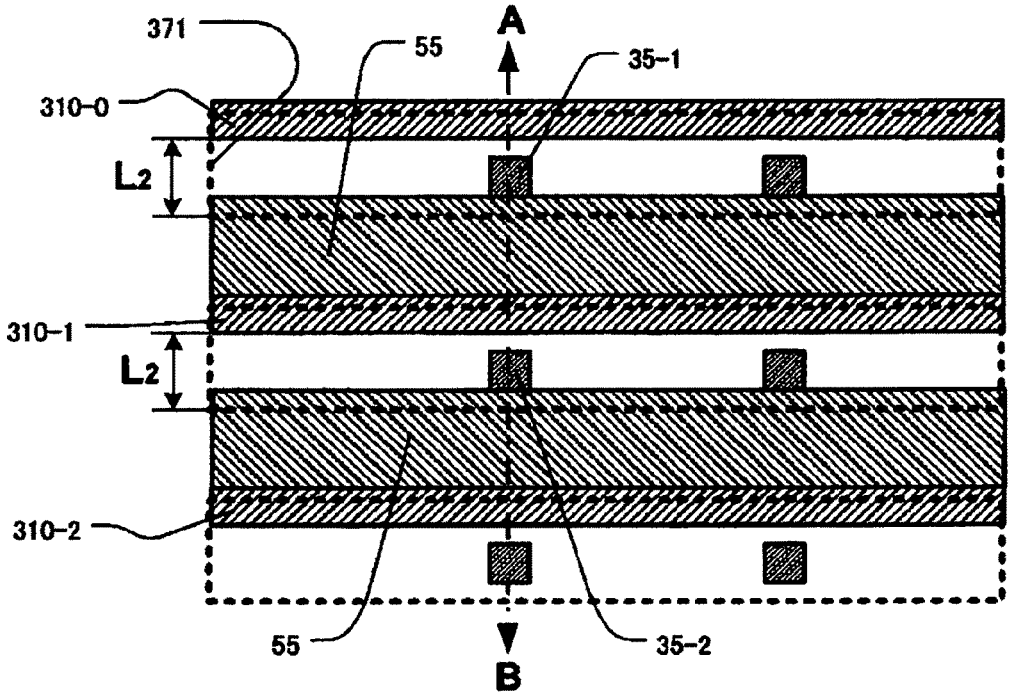
FIG. 33 is a top plan view showing a part of the cathode plate of a fifth embodiment of the image display apparatus according to the present invention.

A fifth embodiment of the present invention will be described with reference to FIGS. 32 and 33. The fifth embodiment uses a thin film electron emitter as an electron emission element. FIG. 32 is a cross section of a part of a display panel 100 used for an image display apparatus of the present embodiment. Further, FIG. 33 is a corresponding top plan view. A cross section along A-B of FIG. 33 is FIG. 32. In FIG. 32, with respect to an electron emission element 301 constituted by the thin film electron emitter, its electron emission region 35 only is described. A description of the internal structure of the thin film electron emitter, that is, the internal structure such as the top electrode 11, the electron acceleration layer 12, and the base electrode 13, and a detailed wiring structure of an interlayer insulating film, a data line and so on are omitted. The detailed structures of these constituent components are the same as the second embodiment.

A top plan view of FIG. 33 is a schematic top plan view showing a positional relation among a scan line 310, a contact electrode 55, an electron emission region 35, and a shield electrode 371, and the illustration of other constituent components are omitted. In FIG. 32, the top electrode 11 of the electron emission element 301 which takes the electron emission region 35 as a constituent component is electrically connected to the scan line 310 via the contact electrode 55. The height of the scan line 310 is 10 μm. On the scan line 310, a dielectric layer 372 is disposed, and upon thereof, the shield electrode 371 is disposed. The shield electrode 371 protrudes immediately above the electron emission region 35, and its protrusion length L2 is 50 μm. The film thickness T2 of the dielectric layer 372 is 100 μm. A distance L0 between the cathode plate 601 and the phosphor plate 602 was taken as 3 mm. A phosphor screen voltage Va was taken as 10 KV. The trajectory of the electron beam emitted from the electron emission region 35 under this condition is an electron trajectory 921 which is obtained by simulation. The electron beam emitted from the electron emission region 35 is deflected by 400 μm when reaching the phosphor plate 602, and bombards or irradiates the phosphor 114 to excite the phosphor to emit light.

The characteristic of the present invention is that the electron emission region 35 is covered with the shield electrode 371 in the projecting plane projecting the shield electrode 371 and the electron emission region 35 in the same plane. That is, the protrusion length L2 of the shield electrode 371 is sufficiently large to cover the entire electron emission region 35. By so doing, even when ion generated close to the phosphor plate 602 inside the panel bombards or irradiates the cathode plate 601, the ion is shielded by the shield electrode 371 and does not reach the electron emission region 35. Hence, the thin film electron emitter constituting the electron emission element 301 is not deteriorated.

The display panel 100 of the present embodiment is fabricated as follows. It is fabricated by the same process as the second embodiment up to the process of FIGS. 21A-21C. Next, it is coated with photosensitive glass, and is patterned, thereby to form the dielectric layer 372. After that, by the processes of FIGS. 22A-22C and 23A-23C, the top electrode 11 is deposited with film, thereby to fabricate the cathode plate 601. When it is combined with the phosphor plate 602 to assemble the display panel 100, the shield electrode 371 of slit form is inserted. At this time, the terminals of the shield electrode 371 are taken out from the display panel. The drive waveform of the image display apparatus of the present embodiment uses a waveform of FIG. 25. The shield electrode 371 is set to 0V.

In the foregoing, the invention made by the inventors of the present invention has been concretely described based on the embodiments. However, it is needless to say that the present invention is not limited to the foregoing embodiments and various modifications and alterations can be made within the scope of the present invention.

What is claimed is:

1. An image display apparatus, comprising a display panel having a cathode plate and a phosphor plate, and a drive circuit, wherein the cathode plate comprises a plurality of electron emission elements, a plurality of scan lines mutually in parallel, and a plurality of data lines mutually in parallel and orthogonal to the scan lines, the electron emission element is a thin film electron emitter, in which a top electrode, an electron acceleration layer, and a base electrode are laminated, and a part of the top electrode constitutes an electron emission region, and by applying a voltage between the top electrode and the base electrode, electrons accelerated in the electron acceleration layer are emitted from the electron emission region, the cathode plate comprises a plurality of deflection electrodes, and has a center line at a position dividing a distance between the inner edges of adjacent the deflection electrodes in two equal parts, the electron emission region is disposed so as not to include the center line, the phosphor plate comprises a phosphor and an acceleration electrode, and is constituted so as to display an image by allowing the emitted electrons to excite the phosphor to emit light, the phosphor plate comprises a phosphor region in which the phosphor is patterned, and a center line of the phosphor region and a center line of the electron emission region are disposed to be shifted to each other.

2. The image display apparatus according to claim 1, wherein a height of the deflection electrode is higher than that of the electron emission region.

3. The image display apparatus according to claim 1, wherein a height of the highest region of the deflection electrode is disposed at a position higher than a height of the highest region of the electron emission region by 2 μm or more.

4. The image display apparatus according to claim 1, wherein the deflection electrode is disposed by a period of sub pixel of a color-image display.

5. The image display apparatus according to claim 1, wherein the deflection electrode is periodically disposed along an axis of the direction in parallel with the scan line.

6. The image display apparatus according to claim 1, wherein the deflection electrode is periodically disposed along an axis of the direction in parallel with the data line.

7. The image display apparatus according to claim 1, wherein the deflection electrode is electrically connected to the scan line.

8. The image display apparatus according to claim 1, wherein the deflection electrode is made of the same material as that of the scan line.

9. The image display apparatus according to claim 1, wherein the cathode plate comprises a contact electrode, wherein the contact electrode is electrically connected to the scan line, and moreover, is electrically connected to the top electrode, and at the same time, is disposed along a side of the longer side from among the sides constituting the electron emission region.

10. The image display apparatus according to claim 1, comprising a constitution in which a deflection pulse is applied to a scan line adjacent to the electron emission element connected to the selected scan line in a period applying a scan pulse to the selected scan line from among the plurality of scan lines.

11. The image display apparatus according to claim 10, wherein assuming that, from among the voltages applied to the scan line from the drive circuit, a voltage of the scan pulse is Vs, a voltage applied to a non-selected scan line is Vns, and a voltage of the deflection pulse is Vdef, the absolute value of (Vs-Vdef) is larger than the absolute value of (Vs-Vns).

12. The image display apparatus according to claim 1, wherein the phosphor plate comprises the phosphor and the acceleration electrode, and is constituted so as to display an image by allowing the emitted electron to excite the phosphor to emit light, wherein, in a projected plane projecting a component on the phosphor plate and a component on the cathode plate, the electron emission region is disposed so as not to be superposed with a region formed with the phosphor.

13. The image display apparatus according to claim 1, wherein the phosphor plate comprises the phosphor, a black matrix and the acceleration electrode, and is constituted so as to display an image by allowing the emitted electron to excite the phosphor to emit light, and wherein, in a projected plane projecting a component on the phosphor plate and a component on the cathode plate, the electron emission region is disposed so as to be included in the black matrix.

14. An image display apparatus comprising a display panel having a cathode plate and a phosphor plate, and a drive circuit, wherein the cathode plate comprises a plurality of electron emission elements, a plurality of scan lines mutually in parallel, and a plurality of data lines mutually in parallel and orthogonal to the scan lines, the electron emission element is a thin film electron emitter, in which a top electrode, an electron acceleration layer, and a base electrode are laminated, and a part of the top electrode constitutes an electron emission region, and by applying a voltage between the top electrode and the base electrode, electrons accelerated in the electron acceleration layer are emitted from the electron emission region, a shield electrode is provided between the electron emission region and the phosphor plate, and wherein, in a projected plane projecting a pattern of the electron emission region and a pattern of the shield electrode, the electron emission region is disposed so as to be included in the shield electrode.

15. An image display apparatus comprising a display panel having a cathode plate and a phosphor plate, and a drive circuit, wherein the cathode plate comprises a plurality of electron emission elements, a plurality of scan lines mutually in parallel, and a plurality of data lines mutually in parallel and orthogonal to the scan lines, the electron emission element comprises a first electrode and a second electrode, and the first electrode is electrically connected to the scan line, and the second electrode is electrically connected to the data line, the electron emission element comprises an electron emission region, and when a voltage is applied between the first electrode and the second electrode, electrons are emitted from the electron emission region, the phosphor plate comprises a phosphor and an acceleration electrode, and is constituted so as to display an image by allowing the emitted electron to excite the phosphor to emit light, and wherein, in a projected plane projecting a component on the phosphor plate and a component on the cathode plate, the electron emission region is disposed so as not to be superposed with a region formed with the phosphor.

16. The image display apparatus according to claim 15, wherein the phosphor plate comprises a black matrix in addition to the phosphor and the acceleration electrode, and wherein, in a projected plane projecting a component on the phosphor plate and a component on the cathode plate, the electron emission region is disposed so as to be included in the black matrix.

17. The image display apparatus according to claim 15, wherein the electron emission element is a thin film electron emitter, in which a top electrode, an electron acceleration layer, and a base electrode are provided, and a part of the top electrode constitutes the electron emission region, and by applying a voltage between the top electrode and the base electrode, electrons are emitted from the electron emission region.

18. The image display apparatus according to claim 16, wherein the electron emission element is a thin film electron emitter, in which a top electrode, an electron acceleration layer, and a base electrode are provided, and a part of the top electrode constitutes the electron emission region, and by applying a voltage between the top electrode and the base electrode, electrons are emitted from the electron emission region.

* * * * *